US007315723B2

(12) United States Patent
Suda et al.

(10) Patent No.: US 7,315,723 B2
(45) Date of Patent: Jan. 1, 2008

(54) METHOD AND APPARATUS FOR IMAGE FORMING CAPABLE OF EFFECTIVELY TRANSPORTING TONER

(75) Inventors: Takeo Suda, Tokyo-to (JP); Shinichi Kawahara, Tokyo-to (JP); Keiichi Yoshida, Kanagawa-ken (JP); Yoshio Hattori, Kanagawa-ken (JP); Yutaka Takahashi, Tokyo-to (JP)

(73) Assignee: Ricoh Co., Ltd., Tokyo (JP)

( * ) Notice: Subject to any disclaimer, the term of this patent is extended or adjusted under 35 U.S.C. 154(b) by 184 days.

(21) Appl. No.: 11/125,177

(22) Filed: May 10, 2005

(65) Prior Publication Data

US 2005/0249533 A1 Nov. 10, 2005

(30) Foreign Application Priority Data

May 10, 2004 (JP) ..... 2004-139454
Feb. 16, 2005 (JP) ..... 2005-038901
Mar. 2, 2005 (JP) ..... 2005-057615

(51) Int. Cl.
*G03G 21/00* (2006.01)

(52) U.S. Cl. ..... 399/358; 399/360

(58) Field of Classification Search ..... 399/358, 399/360, 359

See application file for complete search history.

(56) References Cited

U.S. PATENT DOCUMENTS 5,442,430 A * 8/1995 Ishii et al. ..... 399/344
5,532,795 A 7/1996 Tatsumi et al.
5,678,125 A 10/1997 Kutsuwada et al.
5,815,767 A 9/1998 Kutsuwada et al.
5,887,224 A 3/1999 Mizuishi et al.
5,915,143 A 6/1999 Watanabe et al.
6,006,050 A 12/1999 Watanabe et al.
6,055,388 A 4/2000 Watanabe et al.
6,097,914 A 8/2000 Tanaka et al.

(Continued)

FOREIGN PATENT DOCUMENTS

JP 04142570 A * 5/1992

(Continued)

OTHER PUBLICATIONS

U.S. Appl. No. 10/588,957, filed Aug. 10, 2006, Suda et al.
U.S. Appl. No. 11/519,919, filed Sep. 13, 2006, Tanaka et al.
U.S. Appl. No. 11/528,635, filed Sep. 28, 2006, Kumagai et al.

*Primary Examiner*—Quana Grainger
(74) *Attorney, Agent, or Firm*—Oblon, Spivak, McClelland, Maier & Neustadt, P.C.

(57) ABSTRACT

An image forming apparatus includes a photoconductor, a cleaning device, and a toner transporting device. The photoconductor has a toner image formed thereon. The cleaning device removes toner remaining on the photoconductor. The toner transporting device transports the toner removed by the cleaning device. The toner transporting device includes a first toner transport path forming member, a first toner transporting member, and a length control member. The first toner transporting member is partly provided in the first toner transport path forming member, expands and contracts in a length direction thereof, and transports the toner through the first toner transport path forming member. The length control member is provided at a downstream end of the first toner transport path forming member, and is pressed against the first toner transporting member to keep a constant length of the first toner transporting member. An image forming method is also described.

91 Claims, 17 Drawing Sheets

U.S. PATENT DOCUMENTS

| | | | |
|---|---|---|---|
| 6,336,013 | B1 | 1/2002 | Suda et al. |
| 6,463,237 | B2 | 10/2002 | Suda et al. |
| 6,560,414 | B2 | 5/2003 | Suda et al. |
| 6,807,390 | B2 | 10/2004 | Suda et al. |
| 6,889,023 | B2 | 5/2005 | Suda et al. |
| 2004/0170447 | A1 | 9/2004 | Arai et al. |
| 2004/0258432 | A1 | 12/2004 | Hatori et al. |
| 2004/0265011 | A1 | 12/2004 | Tsuda et al. |
| 2005/0249533 | A1 | 11/2005 | Suda et al. |

FOREIGN PATENT DOCUMENTS

| | | | | |
|---|---|---|---|---|
| JP | 09006202 | A | * | 1/1997 |
| JP | 11-084968 | | | 3/1999 |
| JP | 11-149237 | | | 6/1999 |
| JP | 2000-284594 | | | 10/2000 |
| JP | 2000-284660 | | | 10/2000 |
| JP | 2001-109343 | | | 4/2001 |

* cited by examiner

METHOD AND APPARATUS FOR IMAGE FORMING CAPABLE OF EFFECTIVELY TRANSPORTING TONER

CROSS REFERENCE TO RELATED APPLICATIONS

This application claims priority to Japanese patent application Nos. 2004-139454 filed on May 10, 2004, 2005-038901 filed on Feb. 16, 2005, and 2005-057615 filed on Mar. 2, 2004, the entire contents of each of which are hereby incorporated by reference herein.

BACKGROUND OF THE INVENTION

1. Field of the Invention

This patent specification relates to an image forming method and apparatus, such as a copier, a printer, a facsimile machine, and a complex machine incorporating functions of a copier, a printer, a facsimile machine, and the like. More particularly, this patent specification relates to a method and apparatus for electrophotographic image forming capable of performing direct transfer or indirect transfer, which uses an intermediate transfer member to form an image on a recording medium sheet, such as a plain paper sheet and an OHP (overhead projector) film. Further, this patent specification relates to a toner transporting device used in the image forming apparatus. Furthermore, this patent specification relates to a process cartridge which includes the toner transporting device and at least a photoconductor and associated components including at least a cleaning device configured to be integrally attached to and detached from the image forming apparatus.

2. Discussion of the Background Art

In a background electrophotographic image forming apparatus, toner remains on a photoconductor when a toner image is transferred from the photoconductor to a recording medium. Therefore, a cleaning device removes the remaining toner and electric charges from a surface of the photoconductor so as to prepare the photoconductor for a next image forming operation. The remaining toner removed by the cleaning device is transported by a toner transporting device from the cleaning device and collected in a waste toner tank for disposal or recovered into a developing device for recycling.

In some toner transporting devices, a toner transporting member is provided in a pipe and is rotated so that the toner is transported through the pipe in an axial direction of the toner transporting member. The toner transporting member may be in a screw or spiral shape, for example. A spiral-shaped toner transporting member has no solid core surrounding its axis and thus is more preferable in terms of cost.

For example, a first spiral-shaped toner transporting member is provided in a first pipe, and a second spiral-shaped toner transporting member is provided in a second pipe. Then, the first and second pipes are connected so that toner transported by the first toner transporting member through the first pipe continues to be transported by the second toner transporting member through the second pipe. With this structure, the toner removed by the cleaning device is transported to a targeted location, such as the waste toner tank or the developing device.

A spiral-shaped toner transporting member having no solid core surrounding its axis is inexpensive, but substantially varies in length. Further, an individual spiral-shaped toner transporting member having no solid core surrounding its axis has a length which may change depending on a setting arrangement thereof in a pipe, e.g., the way the spiral-shaped toner transporting member is curved in the pipe. As a result, a downstream end of the spiral-shaped toner transporting member may not reach an exit of the pipe or may stick out of the exit by a substantial length.

If a downstream end of the first toner transporting member does not reach the exit of the first pipe, for example, force of the first toner transporting member to transport the toner is reduced in a space within the first pipe where the downstream end of the first toner transporting member does not reach. As a result, toner blocking occurs at a connection point between the first pipe and the second pipe, blocking passage of the toner.

On the other hand, if the downstream end of the first toner transporting member sticks out of the exit of the first pipe, the protruding portion of the first toner transporting member may interfere with the second pipe or the second toner transporting member. For example, the first toner transporting member may cause problems in a process of assembling the toner transporting device at a manufacturing site. Further, if such components as the waste toner tank and a shutter are provided at the exit of the first pipe, the protruding portion of the first toner transporting member may interfere with them.

In the above-described toner transporting device, in which the first toner transporting member is provided in the first pipe (i.e., a first toner transport path forming member), the first toner transporting member scrapes the toner off an inner circumferential surface of the first pipe. Therefore, it is less likely that the toner adheres to the inner circumferential surface of the first pipe to cause a toner blockage in the pipe.

At an area near the exit of the first pipe where the first pipe is connected to the second pipe, however, the toner free-falls into the second pipe by gravity. Therefore, the area is not provided with a member which actively scrapes off the toner adhered to the inner circumferential surface of the first pipe. Therefore, toner blocks tend to occur in this area. Further, the toner blocks may cause spilling of the toner when the process cartridge including the toner transporting device is detached from the image forming apparatus, for example.

In light of the above, there is another type of background image forming apparatus in which a stirring member is provided at a position near the exit of the first pipe to scrape off the toner adhered to the inner circumferential surface of the first pipe. It is difficult, however, to completely scrape off the toner adhered to the inner circumferential surface of the first pipe, even with the use of the stirring member. In addition, if the toner is highly adherent, it is highly possible that the toner blocks occur.

There is still another type of background image forming apparatus in which the downstream end of the first toner transporting member protrudes out of the exit of the first pipe to scrape off the toner adhered to the inner circumferential surface of the first pipe in the vicinity of the exit of the first pipe. In this case, however, the protruding portion of the first toner transporting member interferes with such components as the second pipe and the second toner transporting member, causing problems in assembling the toner transporting device, as described above. In this case, a relatively large amount of the toner tends to gather around the connection point between the first and second toner transporting members. Therefore, spilling of the toner may also occur when the process cartridge is detached from the image forming apparatus.

Furthermore, there is still yet another type of background image forming apparatus in which the exit of the first pipe is provided with a shutter to reduce the toner spilled when the process cartridge is attached to or detached from the image forming apparatus. This type of image forming apparatus, however, needs a shutter member, increasing the number of components forming the image forming apparatus. Further, it is possible that a relatively large amount of the toner spilled on the shutter leaks out of the toner transporting device when the process cartridge is attached to or detached from the image forming apparatus.

SUMMARY OF THE INVENTION

This patent specification describes an image forming apparatus. In one example, an image forming apparatus includes a photoconductor, a cleaning device, and a toner transporting device. In the image forming apparatus, the photoconductor is configured to have a toner image formed thereon, and the cleaning device is configured to remove toner remaining on the photoconductor after a transfer of the toner image. The toner transporting device is configured to transport the toner removed by the cleaning device. The toner transporting device includes a first toner transport path forming member, a first toner transporting member, and a length control member. The first toner transporting member is partly provided in the first toner transport path forming member, and is configured to expand and contract in a length direction thereof and transport the toner through the first toner transport path forming member. The length control member is provided at a downstream end of the first toner transport path forming member, and is configured to be pressed against the first toner transporting member to keep a constant length of the first toner transporting member.

In the image forming apparatus, the toner transporting device may further include a coil shaft configured to extend straight, and the first toner transporting member may include a toner transporting coil having an upstream portion wound around the coil shaft so that the toner transporting coil and the coil shaft are rotated to transport the toner.

In the image forming apparatus, the coil shaft may be formed into an impeller shape.

Further, in the image forming apparatus, the toner transporting device may further include a tunnel member configured to serve as a bearing for supporting the first toner transporting member and a downstream end of the coil shaft.

Further, in the image forming apparatus, the toner transporting coil may have a downstream end provided with an inwardly-bent portion.

Further, in the image forming apparatus, the coil shaft may have an outer circumferential surface provided with a step configured to engage with and compress a part of the toner transporting coil when the toner transporting coil contracts in the length direction thereof.

Further, in the image forming apparatus, the toner transporting device may further include a second toner transport path forming member and a second toner transporting member. The second toner transport path forming member may be connected to the first toner transport path forming member. The second toner transporting member may be provided in the second toner transport path forming member and configured to continue to transport, through the second toner transport path forming member, the toner transported through the first toner transport path forming member by the first toner transporting member. The length control member may be provided at a connection point between the first and second toner transport path forming members.

Further, in the image forming apparatus, the second toner transport path forming member may be provided at a position below the first toner transport path forming member relative to the connection point.

Further, in the image forming apparatus, the length control member may include a plate having a toner passing hole.

Further, in the image forming apparatus, the length control member may be formed integrally with the first toner transport path forming member.

Further, in the image forming apparatus, the first toner transport path forming member may include a pipe, and the first toner transporting member may include a toner transporting coil which rotates in the pipe to transport the toner. The length control member, which is pressed against the toner transporting coil, may include a protrusion radially and inwardly protruding from an inner circumferential surface of the pipe at a circular-cross-sectioned exit of the pipe.

Further, in the image forming apparatus, the first toner transport path forming member may include a pipe, and the first toner transporting member may include a toner transporting coil which rotates in the pipe to transport the toner. The length control member, which is pressed against the toner transporting coil, may include a bridging member radially extending across a circular-cross-sectioned exit of the pipe.

Further, in the image forming apparatus, the first toner transporting member may include a spiral-shaped member formed from a flat plate.

This patent specification further describes an image forming method for effectively transporting toner. In one example, an image forming method for effectively transporting toner includes: providing a photoconductor, a cleaning device, and a toner transporting device; providing, in the toner transporting device, a first toner transport path forming member, a first toner transporting member configured to expand and contract in a length direction thereof, and a length control member configured to be pressed against the first toner transporting member to keep a constant length of the first toner transporting member; inserting a part of the first toner transporting member in the first toner transport path forming member; locating the length control member at a downstream end of the first toner transport path forming member; forming a toner image on the photoconductor; causing the cleaning device to remove toner remaining on the photoconductor after a transfer of the toner image; and causing the first toner transporting member to transport the toner removed by the cleaning device through the first toner transport path forming member.

The image forming method may further include: providing a coil shaft configured to extend straight; including a toner transporting coil in the first toner transporting member; winding an upstream portion of the toner transporting coil around the coil shaft; and rotating the toner transporting coil and the coil shaft to transport the toner.

The image forming method may further include forming the coil shaft into an impeller shape.

The image forming method may further include providing a tunnel member configured to serve as a bearing for supporting the first toner transporting member and a downstream end of the coil shaft.

The image forming method may further include providing a downstream end of the toner transporting coil with an inwardly-bent portion.

The image forming method may further include: providing an outer circumferential surface of the coil shaft with a step; and causing the step to engage with and compress a part of the toner transporting coil when the toner transporting coil contracts in the length direction thereof.

The image forming method may further include: providing, in the toner transporting device, a second toner transport path forming member and a second toner transporting member; inserting the second toner transporting member in the second toner transport path forming member; connecting the second toner transport path forming member to the first toner transport path forming member; placing the length control member at a connection point between the first and second toner transport path forming members; and causing the second toner transporting member to continue to transport, through the second toner transport path forming member, the toner transported through the first toner transport path forming member by the first toner transporting member.

The image forming method may further include placing the second toner transport path forming member at a position below the first toner transport path forming member relative to the connection point.

The image forming method may further include including a plate having a toner passing hole in the length control member.

The image forming method may further include forming the length control member integrally with the first toner transport path forming member.

The image forming method may further include: including a pipe in the first toner transport path forming member; including, in the first toner transporting member, a toner transporting coil which rotates in the pipe to transport the toner; and providing the length control member, which is pressed against the toner transporting coil, with a protrusion radially and inwardly protruding from an inner circumferential surface of the pipe at a circular-cross-sectioned exit of the pipe.

The image forming method may further include: including a pipe in the first toner transport path forming member; including, in the first toner transporting member, a toner transporting coil which rotates in the pipe to transport the toner; and providing the length control member, which is pressed against the toner transporting coil, with a bridging member radially extending across a circular-cross-sectioned exit of the pipe.

The image forming method may further include including, in the first toner transporting member, a spiral-shaped member formed from a flat plate. This patent specification further describes a process cartridge. In one example, a process cartridge includes a cleaning device, a toner transporting device, and a toner transporting device. The cleaning device is configured to remove toner remaining on a photoconductor, and the toner transporting device is configured to transport the toner removed by the cleaning device. The toner transporting device includes a first toner transport path forming member, a first toner transporting member, and a length control member. The first toner transporting member is partly provided in the first toner transport path forming member and is configured to expand and contract in a length direction thereof and transport the toner through the first toner transport path forming member. The length control member is provided at a downstream end of the first toner transport path forming member and is configured to be pressed against the first toner transporting member to keep a constant length of the first toner transporting member.

In the process cartridge, the toner transporting device may further include a coil shaft configured to extend straight, and the first toner transporting member may include a toner transporting coil having an upstream portion wound around the coil shaft so that the toner transporting coil and the coil shaft are rotated to transport the toner.

In the process cartridge, the coil shaft may be formed into an impeller shape.

In the process cartridge, the toner transporting device may further include a tunnel member configured to serve as a bearing for supporting the first toner transporting member and a downstream end of the coil shaft.

In the process cartridge, the toner transporting coil may have a downstream end provided with an inwardly-bent portion.

In the process cartridge, the coil shaft may have an outer circumferential surface provided with a step configured to engage with and compress a part of the toner transporting coil when the toner transporting coil contracts in the length direction thereof.

In the process cartridge, the toner transporting device may further include a second toner transport path forming member and a second toner transporting member. The second toner transport path forming member may be connected to the first toner transport path forming member. The second toner transporting member may be provided in the second toner transport path forming member and configured to continue to transport, through the second toner transport path forming member, the toner transported through the first toner transport path forming member by the first toner transporting member. The length control member may be provided at a connection point between the first and second toner transport path forming members.

In the process cartridge, the second toner transport path forming member may be provided at a position below the first toner transport path forming member relative to the connection point.

In the process cartridge, the length control member may include a plate having a toner passing hole.

In the process cartridge, the length control member may be formed integrally with the first toner transport path forming member.

In the process cartridge, the first toner transport path forming member may include a pipe, and the first toner transporting member may include a toner transporting coil which rotates in the pipe to transport the toner. The length control member, which is pressed against the toner transporting coil, may include a protrusion radially and inwardly protruding from an inner circumferential surface of the pipe at a circular-cross-sectioned exit of the pipe.

In the process cartridge, the first toner transport path forming member may include a pipe, and the first toner transporting member may include a toner transporting coil which rotates in the pipe to transport the toner. The length control member, which is pressed against the toner transporting coil, may include a bridging member radially extending across a circular-cross-sectioned exit of the pipe.

In the process cartridge, the first toner transporting member may include a spiral-shaped member formed from a flat plate.

This patent specification further describes a toner transporting device. In one example, a toner transporting device includes a first toner transport path forming member, a first toner transporting member, and a length control member. The first toner transporting member is partly provided in the first toner transport path forming member and is configured to expand and contract in a length direction thereof and transport the toner through the first toner transport path forming member. The length control member is provided at a downstream end of the first toner transport path forming member and is configured to be pressed against the first toner transporting member to keep a constant length of the first toner transporting member.

The toner transporting device may further include a coil shaft configured to extend straight, wherein the first toner transporting member may include a toner transporting coil having an upstream portion wound around the coil shaft, and wherein the toner transporting coil and the coil shaft may be rotated to transport the toner.

In the toner transporting device, the coil shaft may be formed into an impeller shape.

The toner transporting device may further include a tunnel member configured to serve as a bearing for supporting the first toner transporting member and a downstream end of the coil shaft.

In the toner transporting device, the toner transporting coil may have a downstream end provided with an inwardly-bent portion.

In the toner transporting device, the coil shaft may have an outer circumferential surface provided with a step configured to engage with and compress a part of the toner transporting coil when the toner transporting coil contracts in the length direction thereof.

The toner transporting device may further include a second toner transport path forming member and a second toner transporting member. The second toner transport path forming member may be connected to the first toner transport path forming member. The second toner transporting member may be provided in the second toner transport path forming member and configured to continue to transport, through the second toner transport path forming member, the toner transported through the first toner transport path forming member by the first toner transporting member. The length control member may be provided at a connection point between the first and second toner transport path forming members.

In the toner transporting device, the second toner transport path forming member may be provided at a position below the first toner transport path forming member relative to the connection point.

In the toner transporting device, the length control member may include a plate having a toner passing hole.

In the toner transporting device, the length control member may be formed integrally with the first toner transport path forming member.

In the toner transporting device, the first toner transport path forming member may include a pipe, and the first toner transporting member may include a toner transporting coil which rotates in the pipe to transport the toner. The length control member, which is pressed against the toner transporting coil, may include a protrusion radially and inwardly protruding from an inner circumferential surface of the pipe at a circular-cross-sectioned exit of the pipe.

In the toner transporting device, the first toner transport path forming member may include a pipe, and the first toner transporting member may include a toner transporting coil which rotates in the pipe to transport the toner. The length control member, which is pressed against the toner transporting coil, may include a bridging member radially extending across a circular-cross-sectioned exit of the pipe.

In one embodiment, the first toner transporting member may include a spiral-shaped member formed from a flat plate.

This patent specification further describes a toner transporting method. In one example, a toner transporting method includes: providing a first toner transport path forming member, a first toner transporting member configured to expand and contract in a length direction thereof, and a length control member configured to be pressed against the first toner transporting member to keep a constant length of the first toner transporting member; inserting a part of the first toner transporting member in the first toner transport path forming member; locating the length control member at a downstream end of the first toner transport path forming member; and causing the first toner transporting member to transport toner through the first toner transport path forming member.

The toner transporting method may further include: providing a coil shaft configured to extend straight; including a toner transporting coil in the first toner transporting member; winding an upstream portion of the toner transporting coil around the coil shaft; and rotating the toner transporting coil and the coil shaft to transport the toner.

The toner transporting method may further include forming the coil shaft into an impeller shape.

The toner transporting method may further include providing a tunnel member configured to serve as a bearing for supporting the first toner transporting member and a downstream end of the coil shaft.

The toner transporting method may further include providing a downstream end of the toner transporting coil with an inwardly-bent portion.

The toner transporting method may further include: providing an outer circumferential surface of the coil shaft with a step; and causing the step to engage with and compress a part of the toner transporting coil when the toner transporting coil contracts in the length direction thereof.

The toner transporting method may further include: providing a second toner transport path forming member and a second toner transporting member; inserting the second toner transporting member in the second toner transport path forming member; connecting the second toner transport path forming member to the first toner transport path forming member; placing the length control member at a connection point between the first and second toner transport path forming members; and causing the second toner transporting member to continue to transport, through the second toner transport path forming member, the toner transported through the first toner transport path forming member by the first toner transporting member.

The toner transporting method may further include placing the second toner transport path forming member at a position below the first toner transport path forming member relative to the connection point.

The toner transporting method may further include including a plate having a toner passing hole in the length control member.

The toner transporting method may further include forming the length control member integrally with the first toner transport path forming member.

The toner transporting method may further include: including a pipe in the first toner transport path forming member; including, in the first toner transporting member, a toner transporting coil which rotates in the pipe to transport the toner; and providing the length control member, which is pressed against the toner transporting coil, with a protrusion radially and inwardly protruding from an inner circumferential surface of the pipe at a circular-cross-sectioned exit of the pipe.

The toner transporting method may further include: including a pipe in the first toner transport path forming member; including, in the first toner transporting member, a toner transporting coil which rotates in the pipe to transport the toner; and providing the length control member, which is pressed against the toner transporting coil, with a bridging member radially extending across a circular-cross-sectioned exit of the pipe.

The toner transporting method may further include including, in the first toner transporting member, a spiral-shaped member formed from a flat plate.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
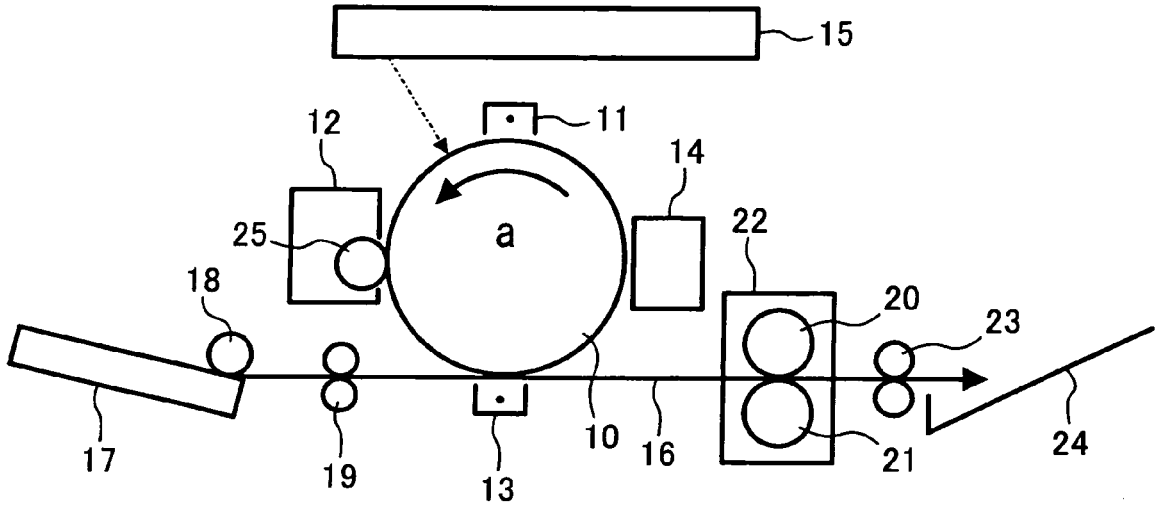
FIG. 1 is a schematic view of the main parts of an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, an image forming apparatus according to an embodiment of the present invention is described.

The image forming apparatus illustrated in FIG. 1 includes a photoconductor 10, a charging device 11, a developing device 12, a transferring device 13, a cleaning device 14, a writing device 15, a recording medium transport path 16, a recording medium storing cassette 17, a sheet-feeding roller 18, a registration roller pair 19, a heat roller 20, a pressure roller 21, a fixing device 22, a ejection roller pair 23, a ejection tray 24, and a developing roller 25.

The photoconductor 10 rotates in a counterclockwise direction indicated by the arrow "a" in FIG. 1. This photoconductor 10 is drum-shaped in the present embodiment but may be replaced by a belt-shaped photoconductor. Such devices as the charging device 11, the developing device 12, the transferring device 13, the cleaning device 14, and an electric charge removing device (not shown) are arranged around the photoconductor 10 in this order in the rotation direction of the photoconductor 10. The charging device 11 is provided above the photoconductor 10 and below the writing device 15. The recording medium transport path 16 is provided to stretch through a space between the photoconductor 10 and the transferring device 13 to convey a recording medium in a left-to-right direction in FIG. 1.

An entrance of the recording medium transport path 16 is located next to the recording medium storing cassette 17, which is externally attached to the image forming apparatus, for example. The recording medium storing cassette 17 stores stacked sheets of recording medium, such as plain paper sheets and OHP films. A sheet-discharging portion of the recording medium storing cassettes 17 is provided adjacent to the sheet-feeding roller 18. The registration roller pair 19 is provided along the recording medium transport path 16 at a position downstream of the sheet-feeding roller 18 and upstream of the photoconductor 10 and the transferring device 13.

The fixing device 22 including the heat roller 20 and the pressure roller 21 is provided along the recording medium transport path 16 at a position downstream of the photoconductor 10 and the transferring device 13. The ejection roller pair 23 is provided along the recording medium transport path 16 at a position downstream of the fixing device 22. The ejection tray 24 is provided at a position downstream of the ejection roller pair 23 and externally attached to the image forming apparatus.

In the image forming apparatus thus configured, the photoconductor 10 rotates, and the charging device 11 applies a bias voltage to a surface of the photoconductor 10 to uniformly charge the surface. Then, the writing device 15 emits a light beam and performs a writing operation by exposing the surface of the photoconductor 10 to the light beam, so that an electrostatic latent image is formed on the surface. Thereafter, toner carried by the developing roller 25 provided in the developing device 12 is attracted to and adhered to the surface of the photoconductor 10 to develop the electrostatic latent image into a visible image with the toner. Accordingly, a toner image is formed on the surface of the photoconductor 10.

Along with the rotation of the photoconductor 10, the sheet-feeding roller 18 is rotated to convey a recording medium sheet from the recording medium storing cassette 17. The recording medium sheet sent by the recording medium storing cassette 17 is conveyed through the recording medium transport path 16 and is stopped by the registration roller pair 19. Then, the registration roller pair 19 is rotated at an appropriate time such that the toner image formed on the surface of the photoconductor 10 is properly placed on the recording medium sheet. The recording medium sheet is further conveyed along the recording medium transport path 16 toward a space formed between the photoconductor 10 and the transferring device 13, where the toner image formed on the photoconductor 10 is transferred to the recording medium sheet by the transferring device 13.

The recording medium sheet to which the toner image has been transferred is then conveyed along the recording medium transport path 16 into the fixing device 22, where the transferred image is fixed on the recording medium sheet by heat and pressure applied respectively by the heat roller 20 and the pressure roller 21. The recording medium sheet on which the toner image has been fixed is then conveyed and discharged by the ejection roller pair 23 to the outside of the image forming apparatus and stacked on the ejection tray 24.

After the toner image is transferred from the surface of the photoconductor 10 to the recording medium sheet, the cleaning device 14 removes remaining toner from the surface of the photoconductor 10 as the photoconductor 10 rotates. Thereafter, the electric charge removing device (not shown) removes electric charges from the surface of the photoconductor 10 to prepare the photoconductor 10 for a next image forming operation.

In the present embodiment, a single cartridge case integrally includes such process devices as the photoconductor 10, the charging device 11, the developing device 12, the cleaning device 14, and the electric charge removing device (not shown), forming a process cartridge which can be entirely attached to or detached from the image forming apparatus. Accordingly, the entire process cartridge can be downsized. Further, when a problem occurs in a certain process device, the process cartridge including the process device can be detached from the image forming apparatus for repair or replacement, making maintenance of the image forming apparatus increasingly convenient.

It is, of course, unnecessary to integrally include in the process cartridge all of the above process devices together with the photoconductor 10. However, the process cartridge according to the present embodiment integrally includes the photoconductor 10 and at least the cleaning device 14.

Figure 2:
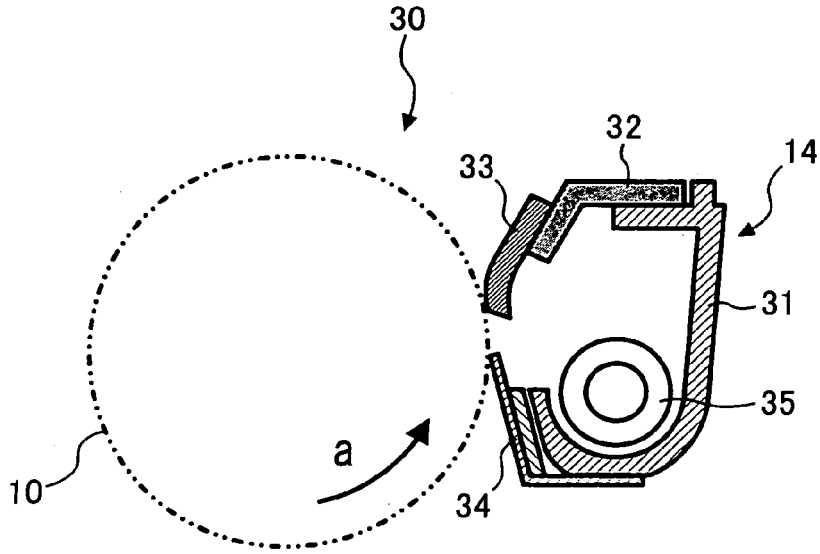
FIG. 2 is a sectional view of a cleaning device provided in the image forming apparatus of FIG. 1.

Description of the cleaning device 14 is provided with reference to FIG. 2. As illustrated in FIG. 2, a process cartridge 30 includes the photoconductor 10 and the cleaning device 14, which is formed by a cartridge case 31, a blade holder 32, a cleaning blade 33, a resin film 34, and a toner transporting coil 35.

The blade holder 32 is attached to the cartridge case 31 of the process cartridge 30 such that the blade holder 32 supports a rear anchor of the cleaning blade 33. A leading edge of the cleaning blade 33 is pressed against an outer circumferential surface of the photoconductor 10. The cartridge case 31 is attached to a rear anchor of the resin film 34, such as a resin sold under the trademark MYLAR, such that a leading edge of the resin film 34 is lightly pressed against the outer circumferential surface of the photoconductor 10. The toner transporting coil 35 is rotatably provided at a bottom of the inside of the cartridge case 31.

In the cleaning device 14 thus configured, as the photoconductor 10 rotates, the cleaning blade 33 scrapes off and removes the toner remaining on the surface of the photoconductor 10. The resin film 34 prevents the scraped-off toner from dropping into the image forming apparatus and collects the scraped-off toner in the cartridge case 31. The toner collected in the cartridge case 31 is gathered by the toner transporting coil 35 to one side of the cleaning device 14, and then is discharged by a toner transporting device according to an embodiment of the present invention (later described) to the outside of the cartridge case 31. Thereafter, the toner is transported to a waste toner tank for disposal or to the developing device 12 for recycling.

Figure 3:
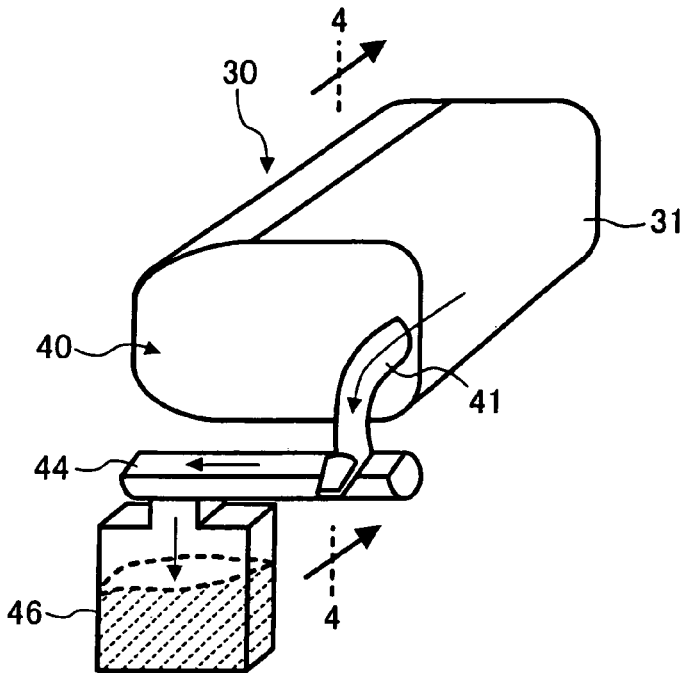
FIG. 3 is a perspective view of an exterior of a toner transporting device provided in the image forming apparatus of FIG. 1.

A toner transporting device 40 included in the image forming apparatus shown in FIG. 1 is now described with reference to FIGS. 3 and 4. FIG. 3 illustrates a perspective view of an exterior of the toner transporting device 40, while FIG. 4 illustrates a longitudinal sectional view of the toner transporting device 40 as cut along a line 4-4 shown in FIG. 3.

FIG. 3 illustrates the toner transporting device 40, which includes a first pipe 41 and a second pipe 44 and is connected to a waste toner tank 46. The first pipe 41 has a circular cross section and protrudes from one side of the process cartridge 30 to extend downward in a curve. A downstream end of the first pipe 41 has an opening facing in an axial direction of the first pipe 41 to form an exit.

Figure 4:
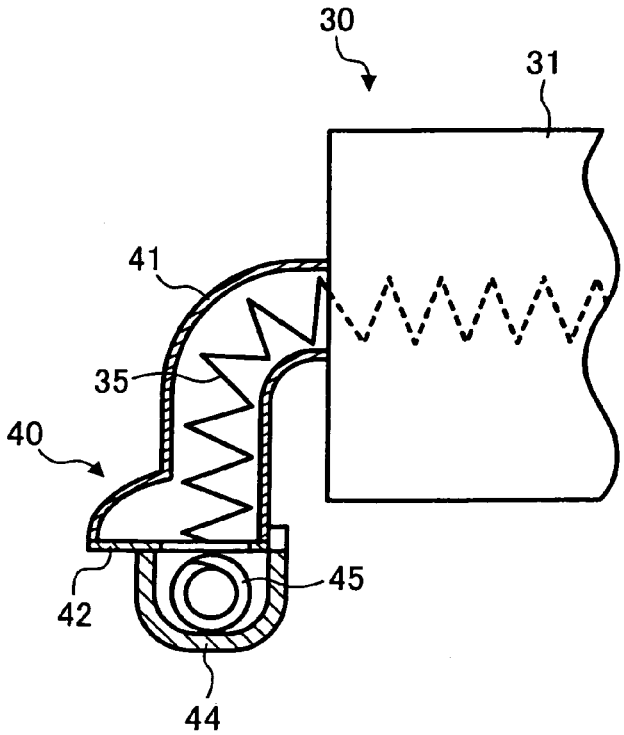
FIG. 4 is a longitudinal sectional view of the toner transporting device of FIG. 3 cut along the line 4-4.

As illustrated in FIG. 4, an end portion of the toner transporting coil 35 provided in the cartridge case 31 is inserted in the first pipe 41. As a result, the toner transporting coil 35 serves as a first toner transporting member.

Figure 5:
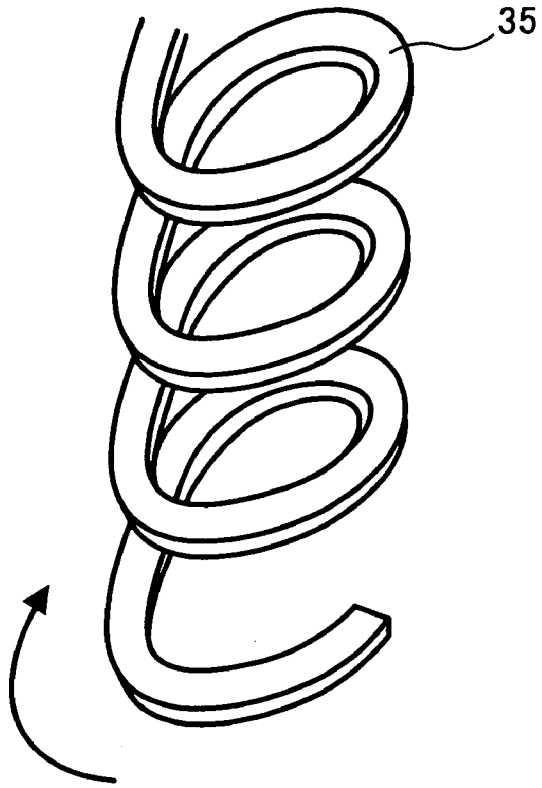
FIG. 5 is a perspective view of a part of a toner transporting coil provided in the toner transporting device of FIG. 3.

As illustrated in FIG. 5, the toner transporting coil 35 may be an elongated flat plate formed into a spiral shape, for example. The toner transporting coil 35 thus configured has increased flexibility, making length control thereof (later described) relatively easy. In the present embodiment illustrated in FIG. 5, the entire toner transporting coil 35 is resilient. It is also possible to make the toner transporting coil 35 partially resilient so that a resilient part of the toner transporting coil 35 can expand and contract in a length direction thereof. Further, the toner transporting coil 35 is configured such that, when external pressure is not applied to the toner transporting coil 35, a leading end of the toner transporting coil 35 protrudes a few millimeters from the downstream end of the first pipe 41, which is the first toner transport path forming member.

Figure 6:
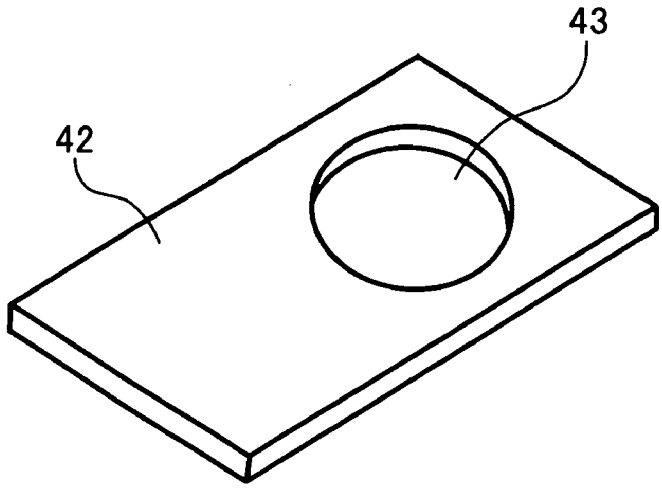
FIG. 6 is a perspective view of a length control member provided in the toner transporting device of FIG. 3.

Referring back to FIG. 4, a length control member 42 is provided at the exit formed in the downstream end of the first pipe 41. The length control member 42 is formed by a plate having a circular toner passing hole 43, such as an approximately 0.3 mm thick stainless plate, for example, as illustrated in FIG. 6. A diameter of the toner passing hole 43 should be smaller than an outer diameter of the toner transporting coil 35. Accordingly, the toner transporting coil 35 is pressed against the length control member 42 and contracts, so that the length of the toner transporting coil 35 is kept constant.

As illustrated in FIG. 4, the first pipe 41 is connected to the second pipe 44, which is a second toner transport path forming member and is placed below the first pipe 41. The exit of the first pipe 41 is connected to an entrance of the second pipe 44 such that the first pipe 41 communicates with the second pipe 44. A second toner transporting member 45 is provided in the second pipe 44. The second toner transporting member 45, which may be in a screw or spiral shape, is rotatably provided around a core axis.

As shown in FIG. 3, in the present embodiment, the waste toner tank 46 is connected to an exit of the second pipe 44. When the toner transporting device 40 transports the toner collected in the cleaning device 14 to the waste toner tank 46, drive sources (not illustrated) drive and rotate the toner transporting coil 35 and the second toner transporting member 45 around respective core axes thereof. Then, the toner discharged outside the cartridge case 31 is transported by the toner transporting coil 35 through the first pipe 41, and into the second pipe 44 through the toner passing hole 43 of the length control member 42. The toner is further transported by the second toner transporting member 45 through the second pipe 44 into the waste toner tank 46. When the waste toner tank 46 is filled with the toner, the entire waste toner tank 46 or the toner occupying the waste toner tank 46 is disposed.

As described above, in the present embodiment, the length control member 42 provided at the downstream end of the first pipe 41 is pressed against the toner transporting coil 35 provided in the first pipe 41, so that the length of the toner transporting coil 35, which is a first toner transporting member, is controlled. Accordingly, in a natural state in which the external pressure is not applied to the toner transporting coil 35, a length of the toner transporting coil 35 is controlled by causing the length control member 42 to compress the toner transporting coil 35 by a length of a portion of the toner transporting coil 35 protruding from the downstream end of the first pipe 41. Further, even if an individual toner transporting coil 35 has a different length, the toner transporting coil 35 can be extended up to the downstream end of the first pipe 41. Accordingly, reduction of the force of the toner transporting coil 35 to transport the toner can be prevented. As a result, occurrence of toner blocks can be prevented.

Furthermore, even if the individual toner transporting coil 35 has the different length, the leading end of the toner transporting coil 35 does not protrude from the downstream end of the first pipe 41. Therefore, it is possible to prevent the leading end of the toner transporting coil 35 from interfering with other components, such as the second pipe 44 provided at the exit of the first pipe 41 and the second toner transporting member 45.

In addition, the first pipe 41 is connected to the second pipe 44 so that the toner transported by the toner transporting coil 35 through the first pipe 41 continues to be transported by the second toner transporting member 45 through the second pipe 44. Therefore, it is possible to prevent toner blocks at the connection point between the first pipe 41 and the second pipe 44 and the interference of the toner transporting coil 35 with other components. Accordingly, it is possible to form the exit of the first pipe 41 at the downstream end thereof in the axial direction, and place the exit close to the entrance of the second pipe 44, so that the toner can be transported from the first pipe 41 into the second pipe 44 by the shortest distance.

Moreover, at the connection point between the first pipe 41 and the second pipe 44, the toner transported by the toner transporting coil 35 through the upper-positioned first pipe 41 flows by gravity into the lower-positioned second pipe 44, so that the toner is transported by the second toner transporting member 45 through the second pipe 44. Accordingly, the toner can be transported by gravity at a part of the connection point between the first pipe 41 and the second pipe 44 where the toner transporting coil 35 does not reach, and thus possibility of toner blocks can be further reduced.

The toner transported by the toner transporting coil 35 is transported into the second pipe 44, for example, through the toner passing hole 43 formed on the plate-shaped length control member 42. That is, the toner transporting coil 35 is not provided in an area of the first pipe 41 where the toner passes through the toner passing hole 43 of the thin plate-shaped length control member 42. Therefore, an area where the force of the toner transporting coil 35 to transport the toner decreases is reduced. Further, the toner transporting coil 35 which actively transports the toner reaches close to the exit of the first pipe 41. Accordingly, the possibility of toner blocks can be still further reduced.

Figure 7:
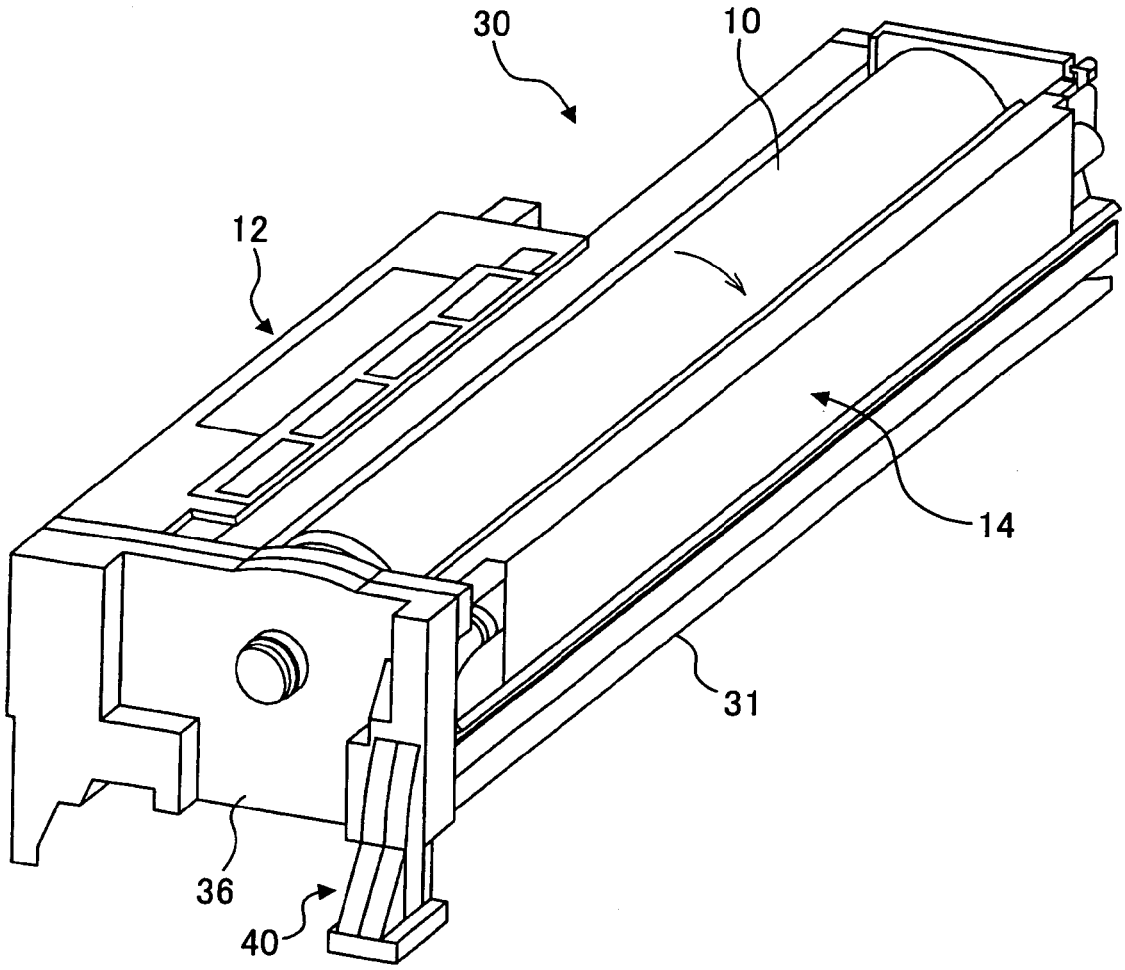
FIG. 7 is a perspective view of a process cartridge according to another embodiment of the present invention.

The process cartridge 30 according to another embodiment of the present invention is described with reference to FIG. 7. The process cartridge 30 includes the cartridge case 31, a cartridge case front plate 36, the photoconductor 10, the developing device 12, the cleaning device 14, and the toner transporting device 40. In the present embodiment, the drum-shaped photoconductor 10 is provided in the cartridge case 31 to be rotatable in a direction indicated by arrow "a" in FIG. 7. The photoconductor 10 is flanked by the developing device 12 and the cleaning device 14. The toner transporting device 40 is provided on the cartridge case front plate 36 at a side of the cleaning device 14 such that the toner transporting device 40 protrudes from the cartridge case front plate 36 to extend downward in a curve.

Figure 8:
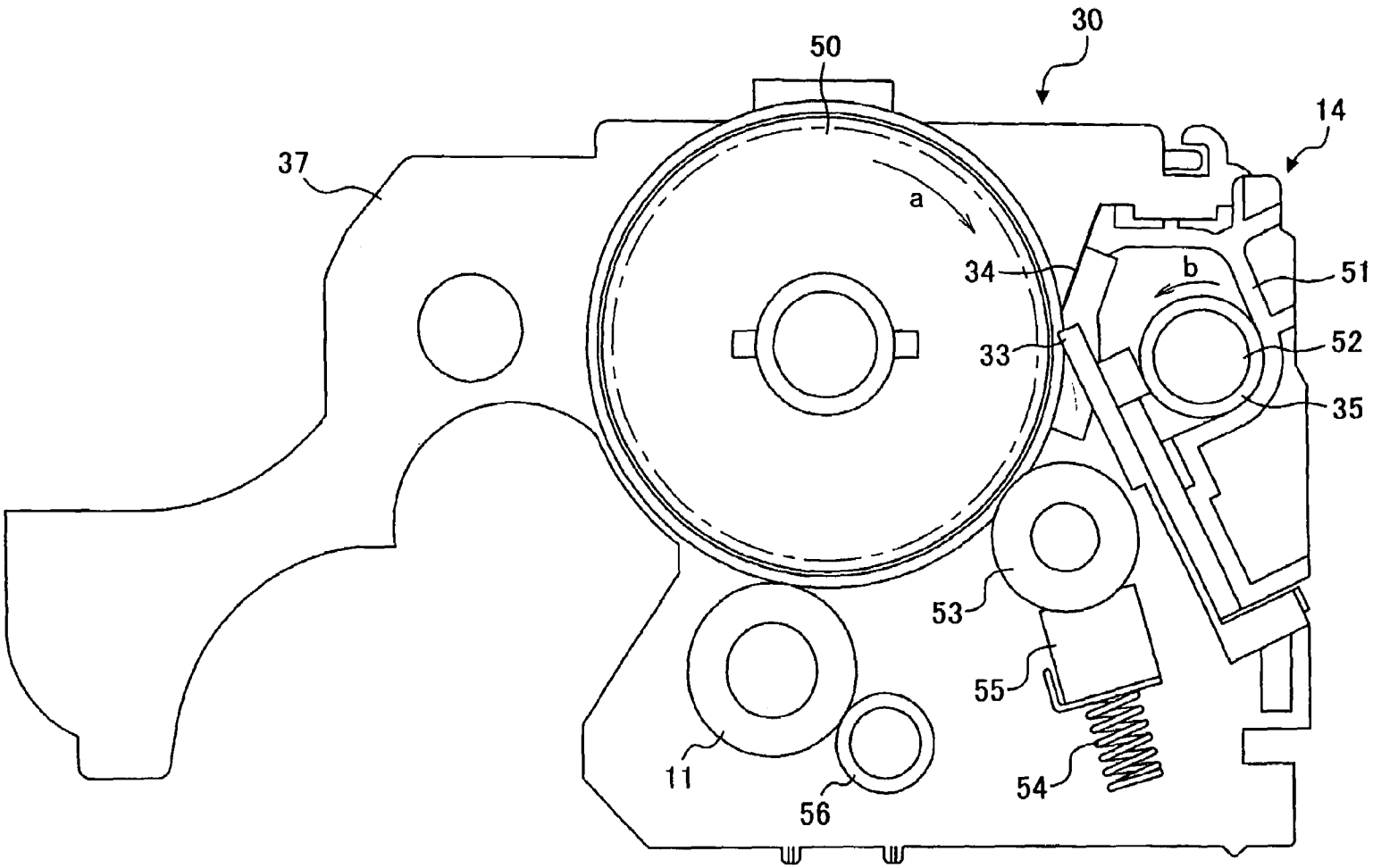
FIG. 8 is a sectional view of the process cartridge of FIG. 7, particularly an area near a back surface of a cartridge case.
Figure 9:
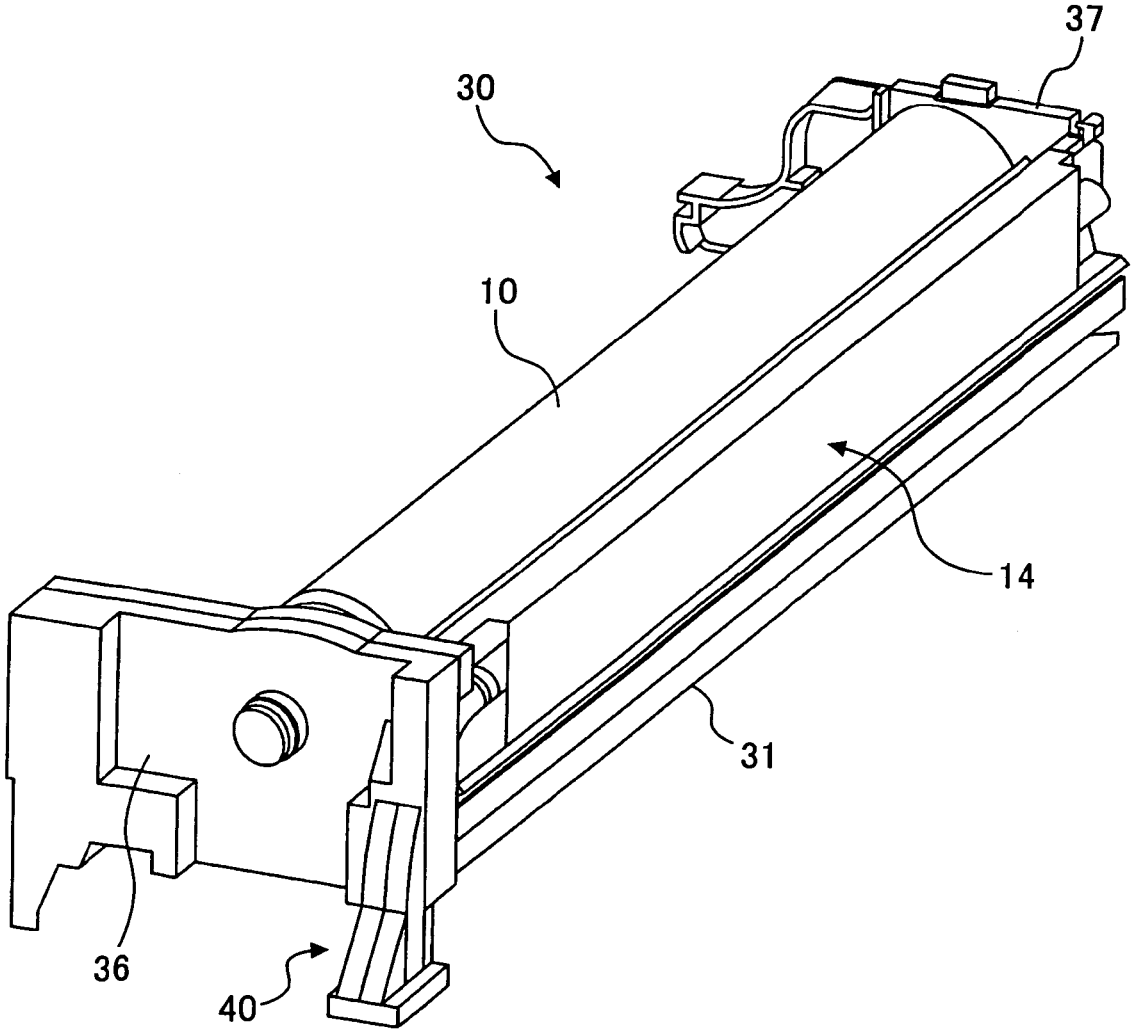
FIG. 9 is a perspective view of the process cartridge of FIG. 7 from which a developing device is removed.

FIG. 8 illustrates a sectional view of the process cartridge 30 at a position close to a cartridge case back plate 37 (shown in FIG. 9). In FIG. 8, the process cartridge 30 includes the charging roller 11, the cleaning device 14, the cleaning blade 33, the resin film 34, the toner transporting coil 35, the cartridge case back plate 37, a geared flange 50, a cleaning case 51, a coil shaft 52, a lubricant coating brush 53, a bias member 54, a solid lubricant 55, and a charging roller cleaner 56. The geared flange 50, which is provided at a backside end of the photoconductor 10, rotates in a clockwise direction (i.e., a direction indicated by arrow "a" shown in FIG. 8). As the geared flange 50 rotates, the geared flange 50 drives the straight coil shaft 52 provided in the cleaning case 51 and the toner transporting coil 35 wound around the coil shaft 52 to serve as the first toner transporting member, so as to rotate the coil shaft 52 and the toner transporting coil 35 in a counterclockwise direction (i.e., a direction indicated in an arrow "b" shown in FIG. 8). An entrance of the cleaning case 51 faces the photoconductor 10. As described above with reference to FIG. 2, the leading edge of the cleaning blade 33 is pressed in an upward direction against the circumferential surface of the photoconductor 10, while the leading edge of the resin film 34 is pressed in a downward direction against the circumferential surface of the photoconductor 10.

In FIG. 8, the lubricant coating brush 53 is provided at a downstream position of the cleaning device 14 in a rotation direction of the photoconductor 10. The lubricant coating brush 53 is pressed against the solid lubricant 55 by the bias member 54. As the photoconductor 10 rotates, the lubricant coating brush 53 rotates to apply a lubricating agent rubbed off from the solid lubricant 55 to the surface of the photoconductor 10. Further, the charging roller 11 is provided at a downstream position of the lubricant coating brush 53 in the rotation direction of the photoconductor 10. The charging roller 11 is pressed against the charging roller cleaner 56 which cleans a surface of the charging roller 11.

Figure 10:
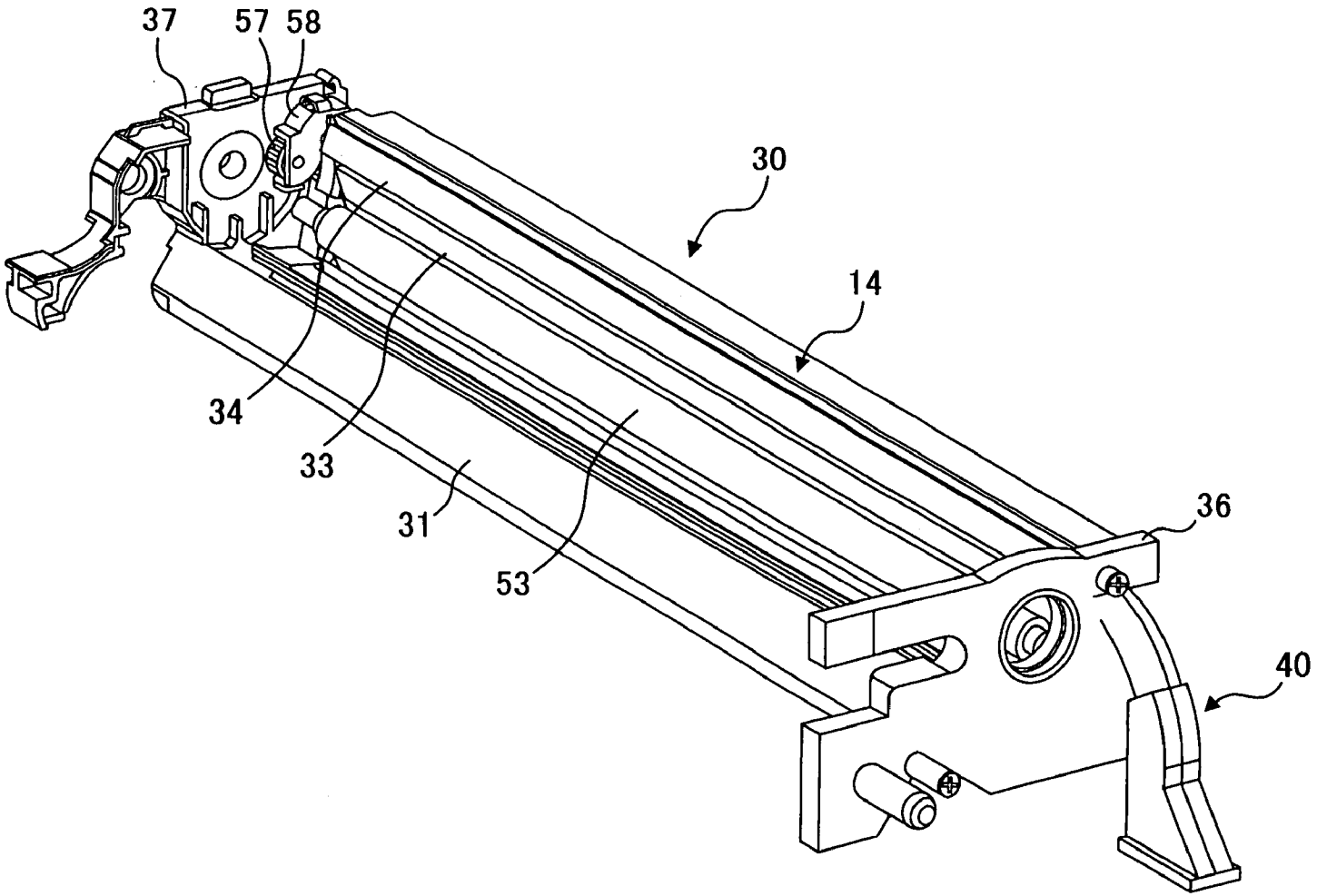
FIG. 10 is a perspective view of the process cartridge of FIG. 7 from which the developing device and a photoconductor are removed, as viewed from an opposite direction to a viewing direction of FIG. 9.
Figure 11:
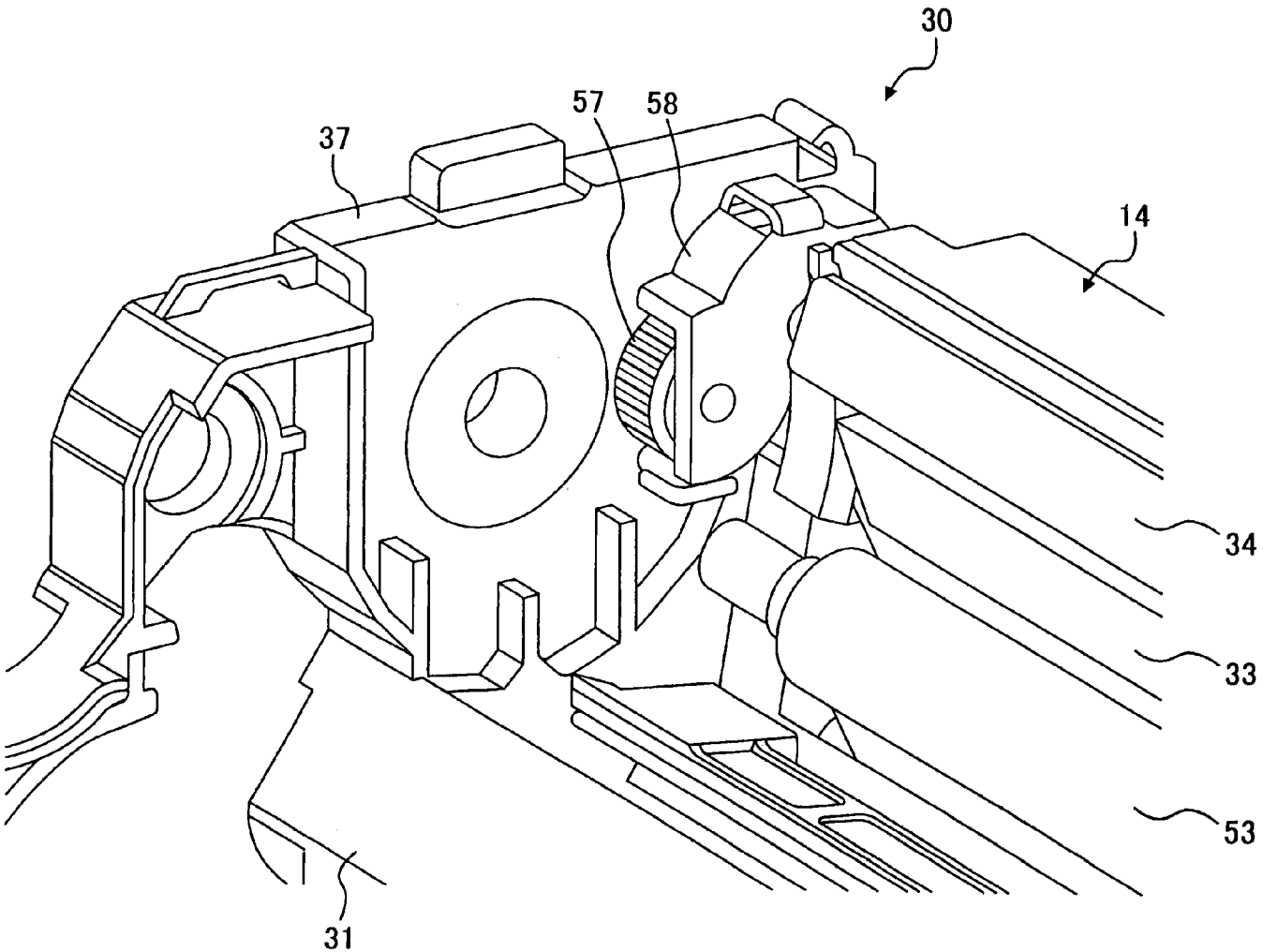
FIG. 11 is an enlarged perspective view of a backside end portion of the process cartridge shown in FIG. 9.

FIG. 9 illustrates the process cartridge 30 with the developing device 12 detached, while FIG. 10 illustrates the process cartridge 30 with the developing device 12 and the photoconductor 10 detached. FIG. 11 illustrates an enlarged view of a backside end portion of the process cartridge 30 shown in FIG. 10.

As illustrated in FIG. 11, a first idler gear 57 and a second idler gear (not shown) are rotatably provided at an inner side of the cartridge case back plate 37. The first idler gear 57 engages with the geared flange 50. Meanwhile, the second idler gear, covered by a covering member 58, engages with the first idler gear 57 and a coil drive gear 60 (shown in FIG. 12) fastened on the coil shaft 52. The coil drive gear 60 is later described. Rotation of the geared flange 50 is transmitted through the first idler gear 57 and the second idler gear to the coil drive gear 60, so that the coil shaft 52 rotates.

Figure 12:
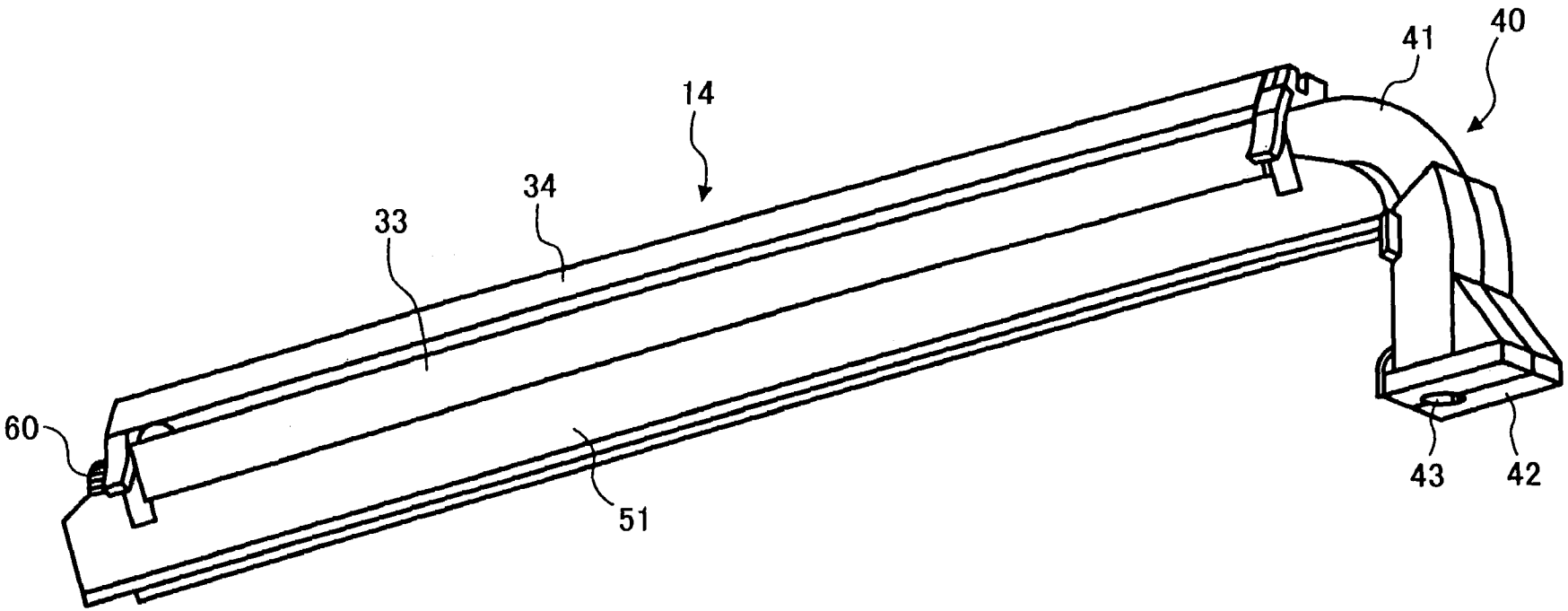
FIG. 12 is a perspective view of an exterior of a cleaning device provided in the process cartridge shown in FIG. 7.

FIG. 12 illustrates an exterior of the cleaning device 14. The cleaning device 14 includes the cleaning case 51, the cleaning blade 33, the resin film 34, and the coil drive gear 60, and is connected to the toner transporting device 40, which includes the first pipe 41, the length control member 42, and the toner passing hole 43. The first pipe 41, which is the first toner transport path forming member, is a circular cross-sectioned pipe through which the toner transport coil 35 runs. The leading end of the first pipe 41 is sealed by the length control member 42 having the toner passing hole 43. As illustrated in FIG. 12, the length control member 42 is not separate from the first pipe 41 but formed of a pipe material to be integrated with the first pipe 41.

Figure 13:
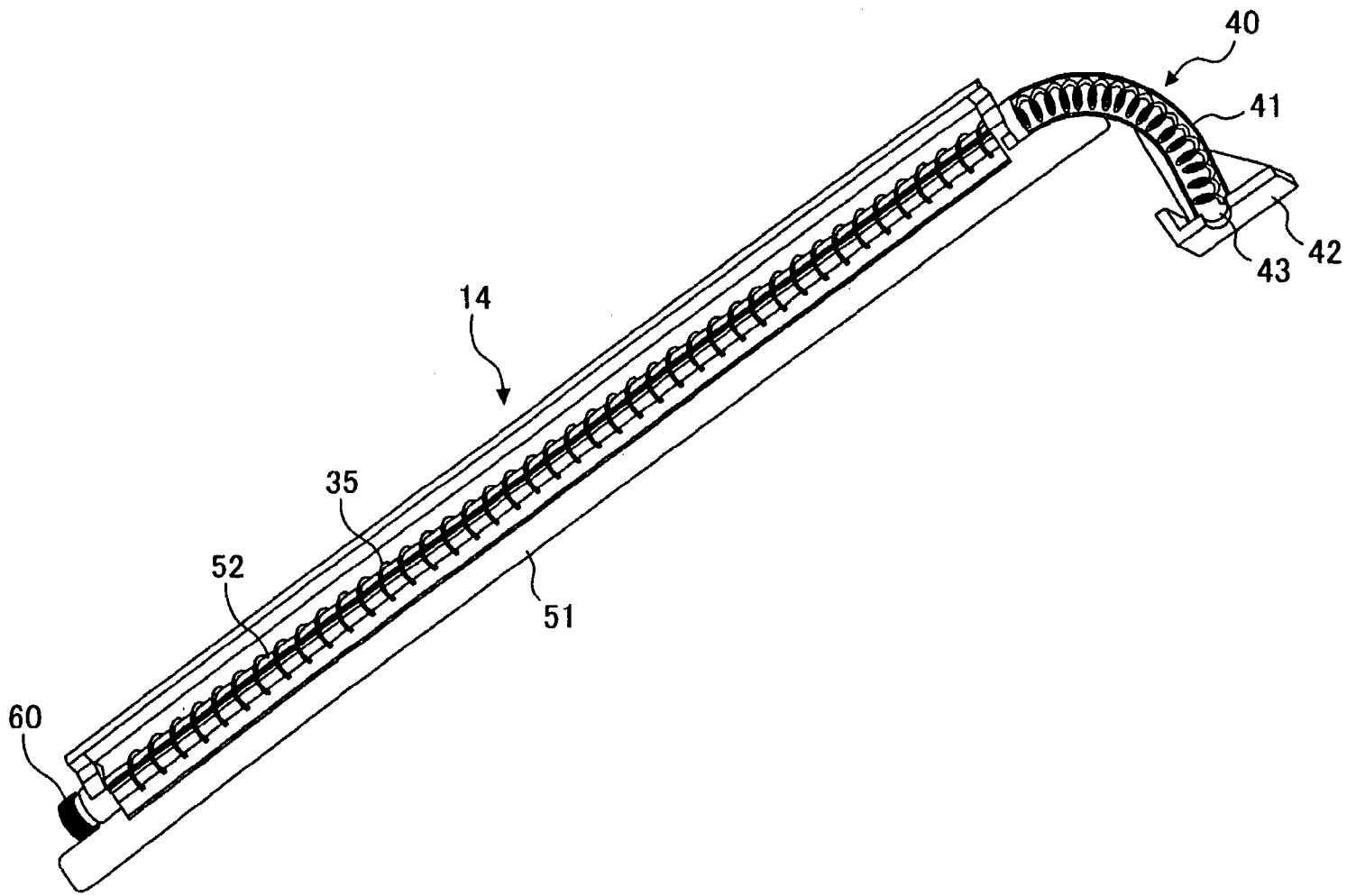
FIG. 13 is a longitudinal sectional view of the cleaning device of FIG. 12.

FIG. 13 illustrates a longitudinal sectional view of the cleaning device 14 shown in FIG. 12. The cleaning device 14 includes the cleaning case 51, the coil shaft 52, the toner transporting coil 35, and the coil drive gear 60, and is connected to the toner transporting device 40, which includes the first pipe 41, the length control member 42, and the toner passing hole 43. The first pipe 41 is formed by combining two semi-cylinders each having a half portion of the length control member 42. The toner transporting coil 35 is provided in the thus configured first pipe 41 such that the toner transporting coil 35 is pressed against the plate-shaped length control member 42 provided at the downstream end of the first pipe 41. Accordingly, the length of the toner transporting coil 35 is kept constant.

Figure 14A:
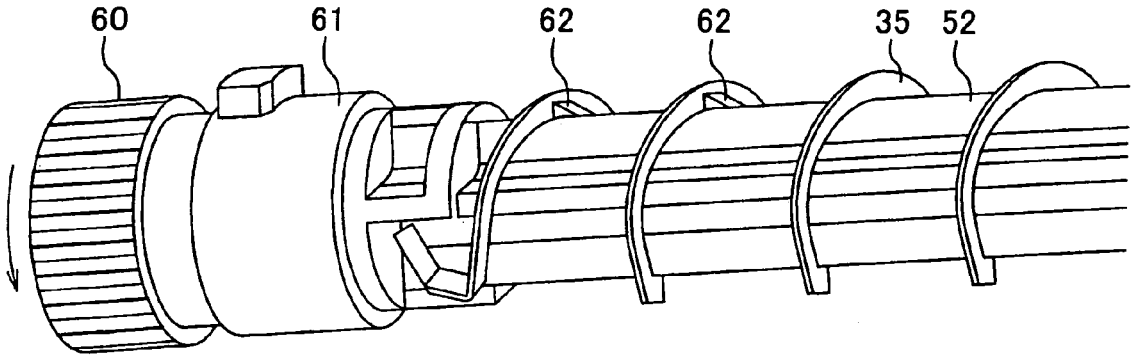
FIG. 14A is a perspective view of a backside portion of a coil shaft wound with a toner transporting coil and provided in the cleaning device of FIG. 12, with a coil drive gear attached to an end of the coil shaft.
Figure 14B:
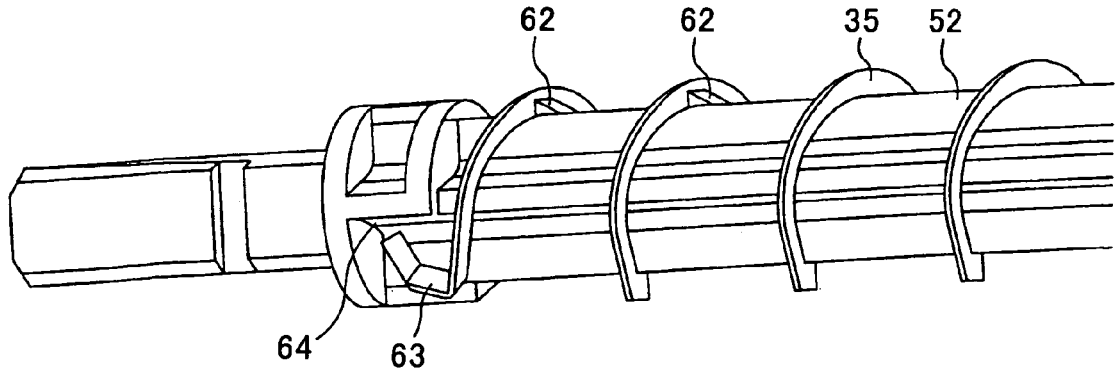
FIG. 14B is a perspective view of the backside portion of the coil shaft wound with the toner transporting coil and provided in the cleaning device of FIG. 12, with the coil drive gear detached from the coil shaft.

FIG. 14A illustrates a backside end portion of the straight coil shaft 52 around which an upstream portion of the toner transporting coil 35 is wound, and which is attached to the coil drive gear 60. Meanwhile, FIG. 14B illustrates the backside end portion of the coil shaft 52 around which the upstream portion of the toner transporting coil 35 is wound, and which is detached from the coil drive gear 60. The coil shaft 52 is formed of a resin material. The central portion of the coil shaft 52 according to the present embodiment has an approximately cross-shaped cross section. Further, as illustrated in FIG. 14B, the coil shaft 52 has a D-shaped cross section at the backside end thereof. Furthermore, as illustrated in FIG. 14A, the coil shaft 52 is supported by a sliding bearing 61 so as not to be displaced. Positions of the coil shaft 52 and the toner transporting coil 35 in the cleaning case 51 are determined by adjusting the sliding bearing 61.

Simply providing the toner transporting coil 35 in the cleaning case 51 may cause aggregation of the toner remaining in an empty space formed within the toner transporting coil 35. As a result, clumps of the toner may be formed and transported, and the aggregation of the toner progresses at a downstream position, causing toner blocks. In a toner-recycling image forming apparatus, the aggregated toner recovered into the development device 12 cannot be directly used for a developing operation. Therefore, extra processes such as a process of grinding the toner clumps into fragments and a classification process should be performed. In the present embodiment, therefore, the cross section of the coil shaft 52 is formed into an approximately cross-shape, so that the coil shaft 52 functions as an impeller which flicks off the toner entered in the empty space formed within the toner transporting coil 35. Accordingly, the toner transporting coil 35 can transport the toner without allowing progress of the toner aggregation.

In the present embodiment, the first pipe 41 of the toner transporting device 40, in which the downstream portion of the toner transporting coil 35 is inserted, is bent to minimize the size of the device. As a result, the first toner transport path of the first pipe 41 is formed in an R-shape. Therefore, the toner transporting coil 35 rubs against the inner circumferential surface of the first pipe 41. Thus, the toner tends to aggregate more easily in this R-shaped area than in a straight stretched portion of the first pipe 41. In the present embodiment, however, at the upstream position of the toner transporting coil 35, the toner transporting coil 35 is wound around the impeller-shaped coil shaft 52 having the approximately cross-shaped cross section, as described above. Therefore, the aggregation of the toner can be reduced in the cleaning case 51. As a result, the aggregation of the toner can be effectively prevented also at a downstream position of the toner transporting coil 35.

Further, the D-shaped cross section of the coil shaft 52 is inserted in a D-shaped hole formed in an axial center of the coil drive gear 60. The coil drive gear 60 is fastened on the coil shaft 52 such that relative rotation of the coil drive gear 60 is not allowed. Accordingly, as the rotation of the geared flange 50 is transmitted to the coil drive gear 60, the rotation is further transmitted to the coil shaft 52. As a result, the coil shaft 52 and the toner transporting coil 35 are rotated, and the toner collected in the cleaning case 51 is transported toward the front side.

The toner transporting coil 35 is a stainless-steel flat plate shaped into a spiral so as to expand and contract in a length direction thereof. An inside diameter of the toner transporting coil 35 is slightly larger than a diameter of the coil shaft 52. When a front side end of the coil shaft 52 is inserted in the toner transporting coil 35 and the coil shaft 52 is almost entirely inserted in the toner transporting coil 35, the toner transporting coil 35 is pressed against two claws 62 formed on the circumferential surface of the coil shaft 52. As a result, the toner transporting coil 35 slides on inclinations of the claws 62 while changing a form of the toner transporting coil 35, and sequentially climbs over the two claws 62. Having climbed over the two claws 62, the toner transporting coil 35 is prevented from being disengaged from the two claws 62. Further, as illustrated in FIG. 14B, the toner transporting coil 35 has a bent backside end portion 63. The end portion 63 is engaged with a step 64 formed on the coil shaft 52. Accordingly, the toner transporting coil 35 rotates along with the coil shaft 52.

Figure 15:
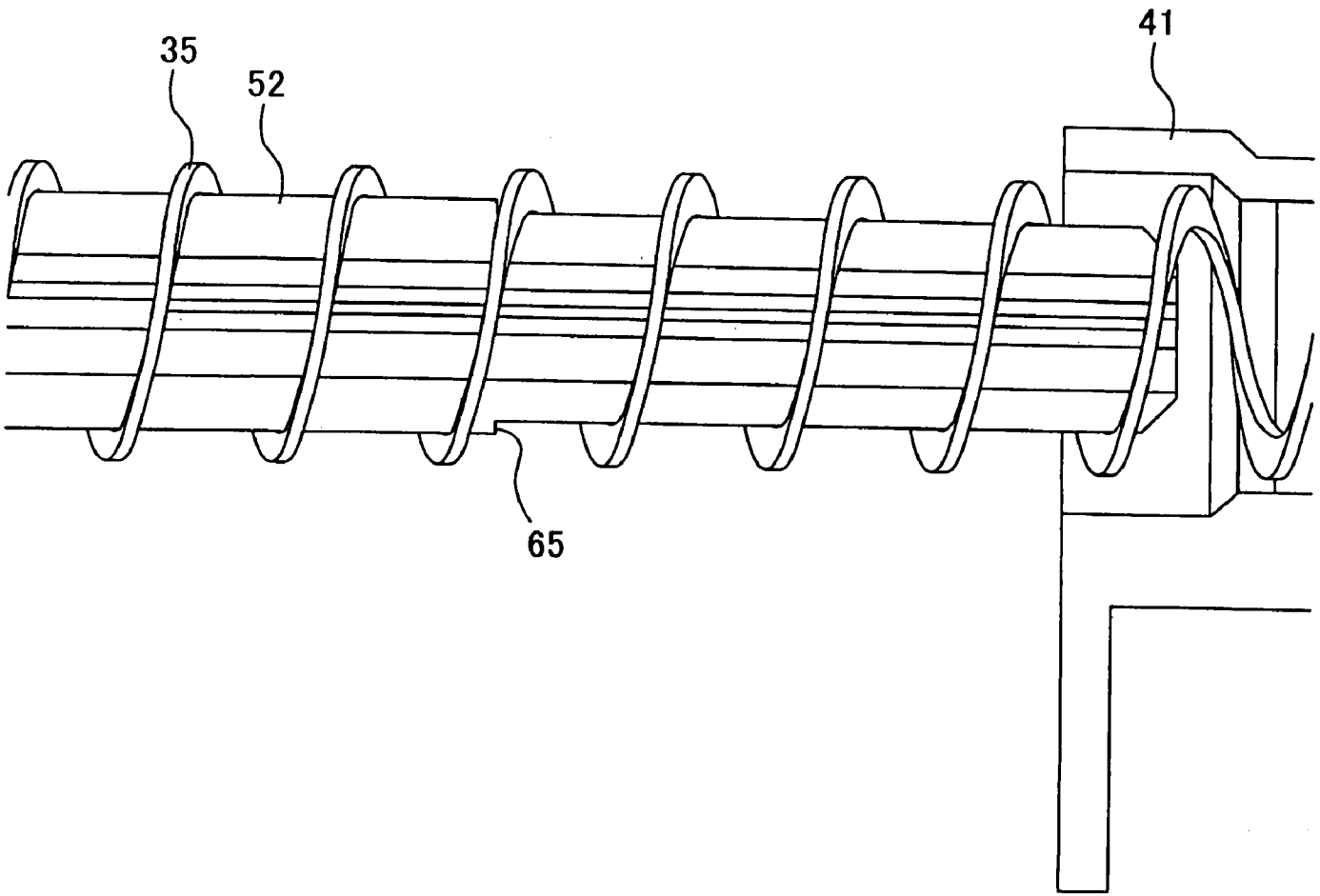
FIG. 15 is a front view of a front side portion of the coil shaft wound with the toner transporting coil.

FIG. 15 illustrates a front side of the coil shaft 52 around which the toner transporting coil 35 is wound. As illustrated in FIG. 15, the diameter of the coil shaft 52 is slightly reduced at a front side end thereof, so that a step 65 is formed around the outer circumferential surface of the coil shaft 52. To fit snugly around a portion of the coil shaft 52 having the reduced diameter, an outer diameter of a portion of the toner transporting coil 35 is also reduced, and an inside diameter of the portion of the toner transporting coil 35 is slightly reduced.

Figure 16:
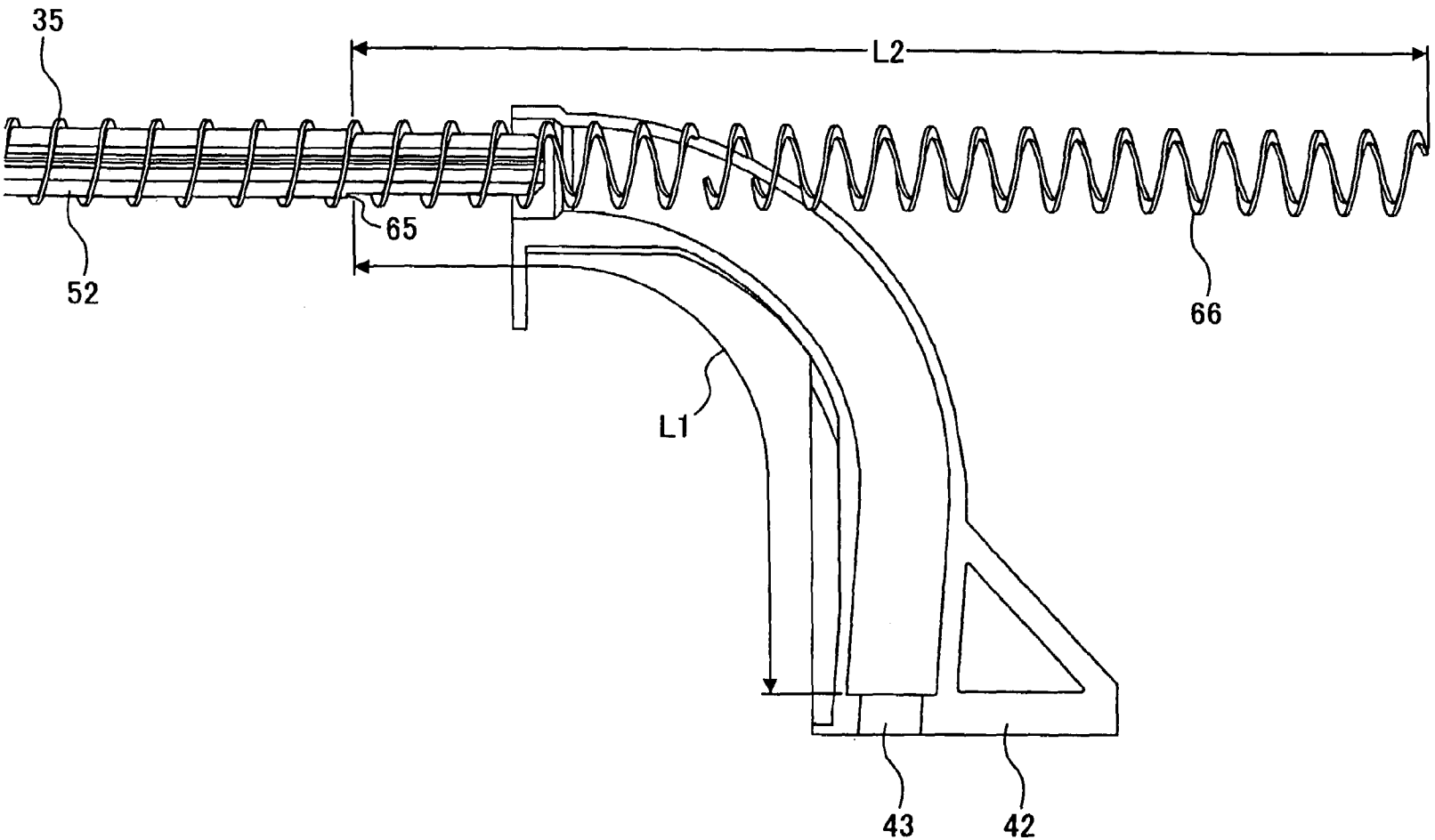
FIG. 16 is a diagram illustrating a distance from a step formed on an exterior of the coil shaft to the length control member, and a natural length of a reduced diameter portion of the toner transporting coil.

FIG. 16 illustrates distances L1 and L2. The distance L1 is a distance from the length control member 42 to the step 65 formed around the outer circumferential surface of the coil shaft 52. Meanwhile, the distance L2 is a natural length (the length with any force on the coil) of the portion of the toner transporting coil 35 having the reduced inside diameter, i.e., a natural length of a reduced diameter portion 66.

With tolerances taken into consideration, in an embodiment where the distance L1 is smaller than the distance L2, the leading end of the toner transporting coil 35 presses against the length control member 42. Since the reduced diameter portion 66 of the toner transporting coil 35 is inserted in the curved first pipe 41, a pitch of the toner transporting coil 35 is reduced to decrease stress. Although it is possible to reduce the pitch of the entire toner transporting coil 35, it is not preferable in terms of cost.

In one embodiment, the toner transporting coil 35 is reduced in resiliency and increased in flexibility to allow the length control member 42 to easily control the length of the toner transporting coil 35. In this case, when pressure applied on the toner transporting coil 35 is increased while the toner transporting coil 35 transports the toner toward the front side thereof, the leading end of the toner transporting coil 35 is easily pushed back toward the backside of the toner transporting coil 35. If the coil shaft 52 does not have the step 65, and if the toner transporting coil 35 does not have the reduced inside diameter, the entire toner transporting coil 35 contracts, and thus the leading end of the toner transporting coil 35 is separated from the length control member 42. For example, if the entire length of the toner transporting coil 35 is 400 millimeters, and if the toner transporting coil 35 contracts to be reduced in length by 4 millimeters, the reduced length of 4 millimeters is one percent of the entire length. Therefore, little repulsive force is generated by the toner transporting coil 35, and thus relatively small pressure can compress the toner transporting coil 35 by a relatively large amount.

In light of the above, the step 65 is formed around the outer circumferential surface of the coil shaft 52, and the inside diameter of the toner transporting coil 35 is reduced. With this configuration, the reduced diameter portion 66 of the toner transporting coil 35 butts against the step 65, so that a part of the toner transporting coil 35 is compressed by pressure. Accordingly, even when the applied pressure is relatively small, the repulsive force of the toner transporting coil 35 is increased to reduce an amount of compression of the toner transporting coil 35, preventing the leading end of the toner transporting coil 35 from being easily separated from the length control member 42.

Figure 17:
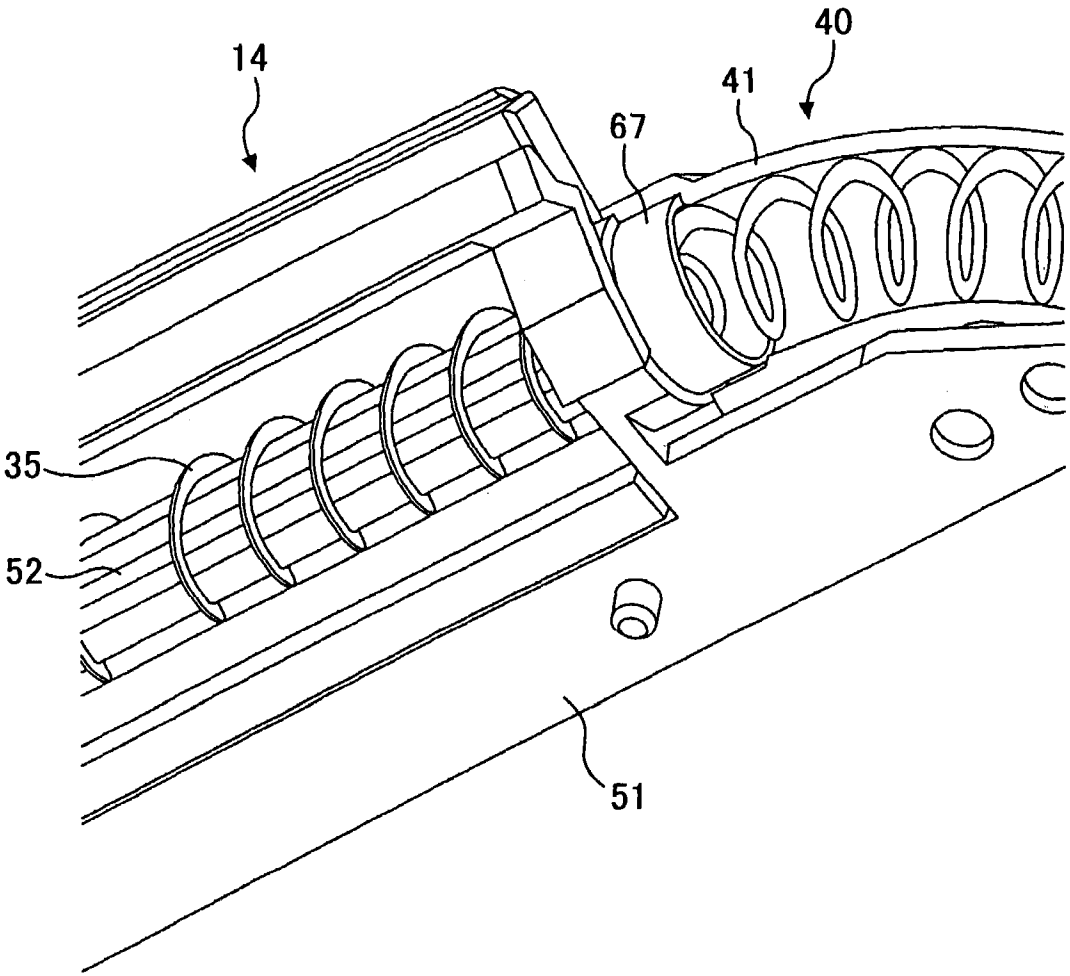
FIG. 17 is a sectional view of a boundary area between the cleaning device and the toner transporting device.

FIG. 17 illustrates a sectional view of a boundary area between the cleaning device 14 and the toner transporting device 40. As illustrated in FIG. 17, a ring-shaped tunnel member 67 is fastened at the entrance of the first pipe 41 of the toner transporting device 40. An inside diameter of the tunnel member 67 is slightly larger than the outer diameter of the reduced diameter portion 66 of the toner transporting coil 35. The front side end of the coil shaft 52 wound with the toner transporting coil 35 is inserted in the tunnel member 67.

Since the downstream portion of the toner transporting coil 35 is inserted in the bent first pipe 41, the downstream portion of the toner transporting coil 35 is curved and tends to be shaken when rotated. Therefore, the coil shaft 52, along with the toner transporting coil 35, is inserted in the tunnel member 67, so that the tunnel member 67 serves as a bearing for stably supporting the toner transporting coil 35 and the downstream end of the coil shaft 52. The toner transporting coil 35 which passes through the tunnel member 67 is positioned within the first pipe 41. The outer diameter of the downstream portion of the toner transporting coil 35, i.e., the reduced diameter portion 66 which is formed into a curve, is slightly smaller than the inside diameter of the first pipe 41.

Figure 18:
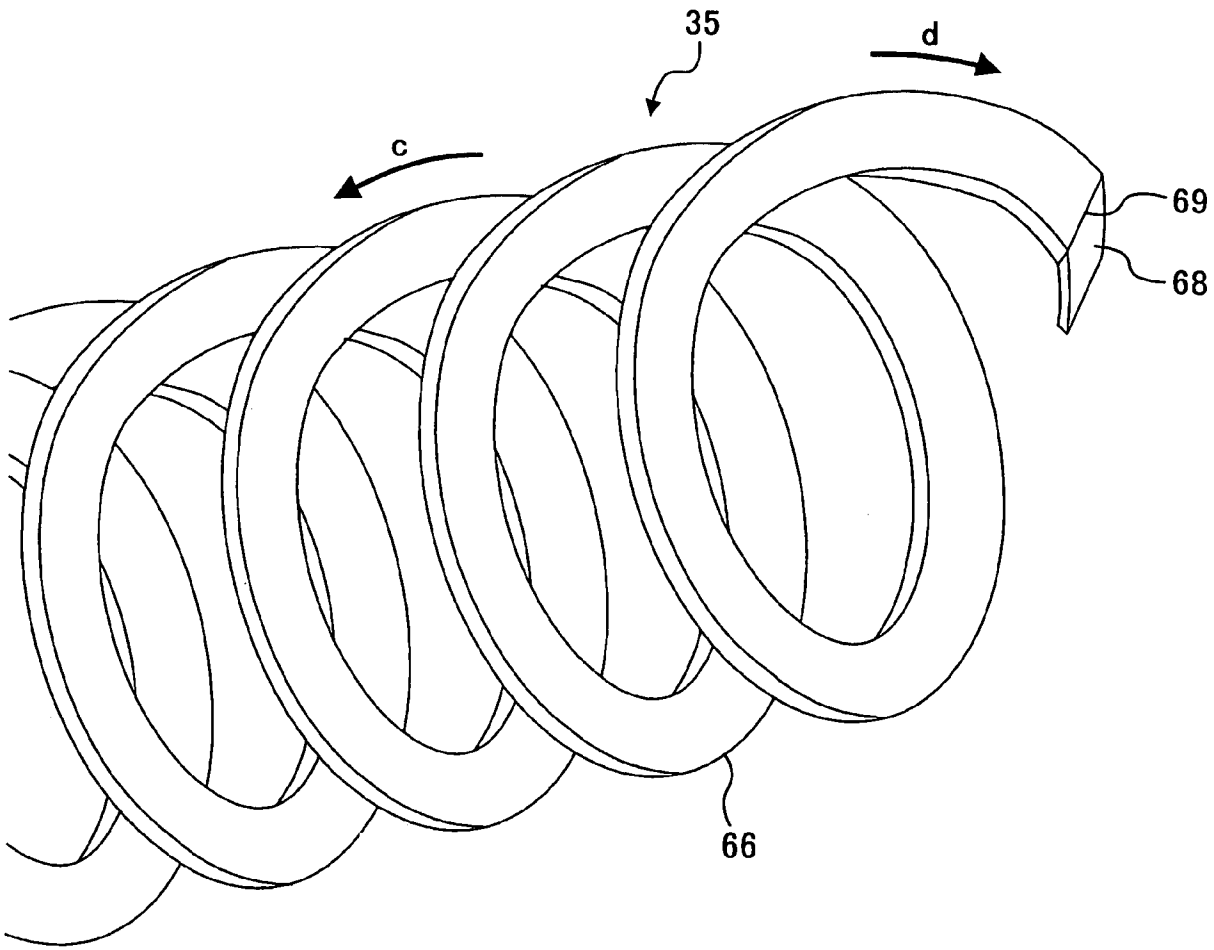
FIG. 18 is a perspective view of a front-side leading end of the toner transporting coil.

FIG. 18 illustrates a front-side end of the toner transporting coil 35. As illustrated in FIG. 18, the toner transporting coil 35 is configured such that the leading end of the toner transporting coil 35 extends in a direction indicated by an arrow "d," which is opposite to a rotation direction of the toner transporting coil 35, which is indicated by an arrow "c" shown in FIG. 18. Accordingly, when the leading end of the toner transporting coil 35 is almost caught by the length control member 42, the leading end of the toner transporting coil 35 can escape from the length control member 42. Further, the front-side end of the toner transporting coil 35 is bent inward to form a bent portion 68. Therefore, a top 69 of the bent portion 68 is pressed against the length control member 42, preventing the toner transporting coil 35 from being caught by the length control member 42.

As described above, the first pipe 41 according to the present embodiment is formed by combining the two semi-cylinders each having a half of the length control member 42. With this configuration, a resin mold for producing the first pipe 41 can be manufactured at relatively low cost. Due to variation in molds within the size tolerance however, a slight bump may be formed along an area where the two halves of the length control member 42 are combined. Particularly in the present embodiment where the first pipe 41, which is the first toner transport path forming member, is formed by combining the two semi-cylinders each having a half of the length control member 42, the toner transporting coil 35 should not be caught by any other component. The inwardly-directed bent portion 68 formed at the front-side end of the toner transporting coil 35 is, therefore, effective in the above type of toner transporting devices.

Figure 19:
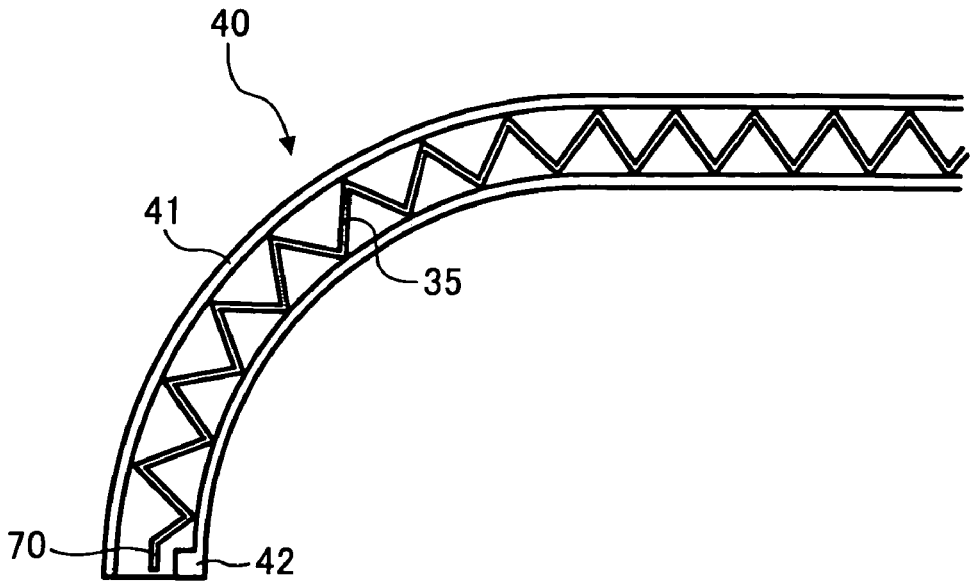
FIG. 19 is a sectional view of a toner transporting device according to another embodiment of the present invention.
Figure 20:
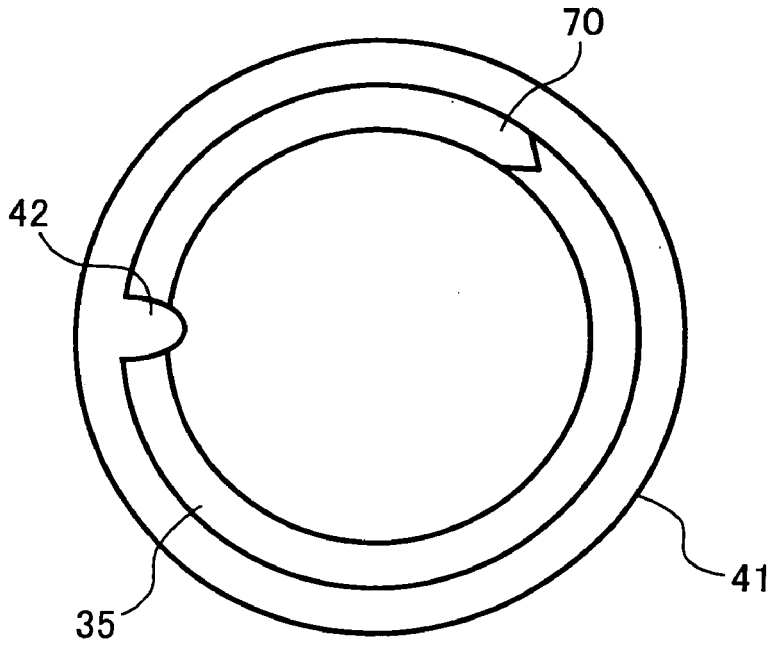
FIG. 20 is a view of an exit of a first pipe provided in the toner transporting device of FIG. 19, as viewed from outside.

FIG. 19 illustrates a sectional view of the toner transporting device 40 according to another embodiment. FIG. 20 illustrates the exit of the first pipe 41, which is the first toner transport path forming member of the toner transporting device 40, as viewed from the outside.

In the toner transporting device 40 according to the another embodiment, the first pipe 41 is curved and has a circular cross section to form the first toner transport path forming member. Further, the toner transporting coil 35 is used as the first toner transporting member, which is inserted and rotated in the first pipe 41 to transport the toner. The length control member 42, which is pressed against the toner transporting coil 35, is formed at the exit of the first pipe 41 having the circular cross section, such that the length control member 42 protrudes inward from the inner circumferential surface of the first pipe 41. Although a single length control member 42 is provided in the embodiment illustrated in FIGS. 19 and 20, a plurality of the length control members 42 may be provided.

In the present embodiment, when the toner transporting coil 35 is rotated in the first pipe 41, a leading end 70, which is at the downstream end of the toner transporting coil 35, climbs over the length control member 42 at least once in each rotation of the toner transporting coil 35. Every time the leading end 70 climbs over the length control member 42, the toner transporting coil 35 expands and contracts in the length direction thereof, causing vibration. As a result, the toner remaining on the toner transporting coil 35 or near the circular cross-sectioned exit of the first pipe 41 is shaken off. Therefore, the toner remaining near the circular cross-sectioned exit of the first pipe 41 is reduced in amount. Accordingly, when the process cartridge including the toner transporting device 40 according to the present embodiment is detached from the image forming apparatus, spilling of the toner from the exit of the first pipe 41 can be prevented.

For example, if the shape of the leading end 70 of the toner transporting coil 35 is designed such that the leading end 70 is tightly caught by the length control member 42, flexibility of the toner transporting coil 35 is increased to enhance the repulsive force thereof. As a result, the toner remaining on the toner transporting coil 35 or near the circular cross-sectioned exit of the first pipe 41 is shaken off, and the amount of the toner remaining near the circular cross-sectioned exit of the first pipe 41 can be reduced.

Figure 21:
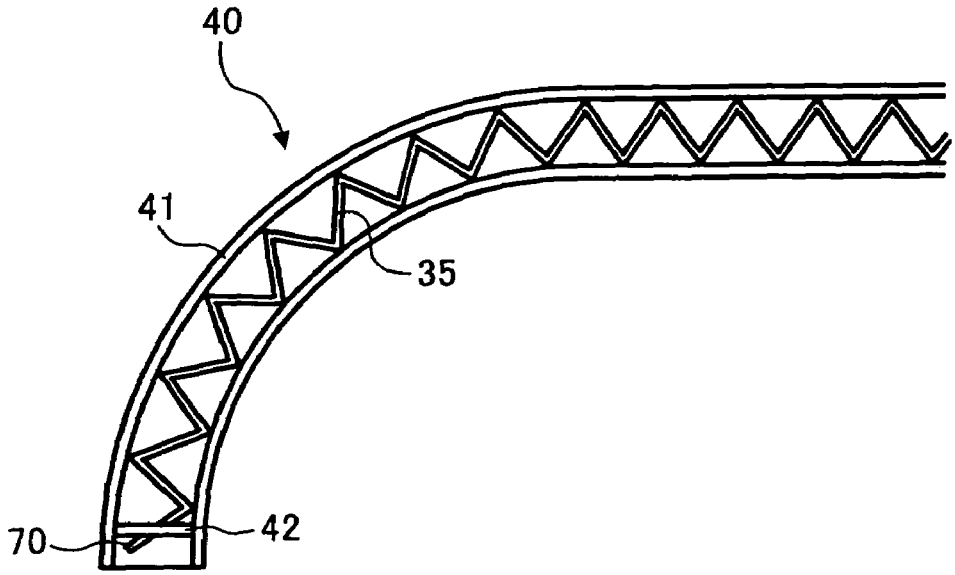
FIG. 21 is a sectional view of a toner transporting device according to still another embodiment of the present invention.
Figure 22:
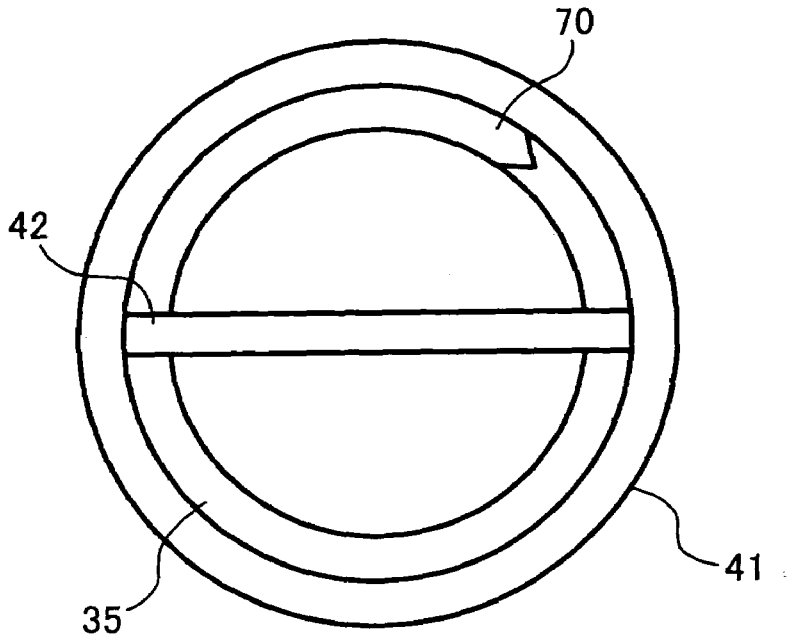
FIG. 22 is a view of an exit of a first pipe provided in the toner transporting device of FIG. 21, as viewed from outside.

FIG. 21 illustrates a sectional view of the toner transporting device 40 according to still another embodiment. FIG. 22 illustrates the exit of the first pipe 41, which is the first toner transport path forming member of the toner transporting device 40, as viewed from the outside.

Similar to the embodiment described above, in the toner transporting device 40 according to this embodiment, the first pipe 41 is curved and has a circular cross section to form the first toner transport path forming member. Further, the toner transporting coil 35 is used as the first toner transporting member, which is rotated in the first pipe 41 to transport the toner. The length control member 42, which is pressed against the toner transporting coil 35, is formed to pass across the circular cross-sectioned exit of the first pipe 41 in a diameter direction. The toner transporting device 40 illustrated in FIGS. 21 and 22 is an example of such an embodiment. Therefore, a plurality of the length control members 42 may be provided to cross one another.

With this configuration, when the toner transporting coil 35 is rotated in the first pipe 41, the leading end 70, which is at the downstream end of the toner transporting coil 35, climbs over the length control member 42 at least twice in each rotation of the toner transporting coil 35. Every time when the leading end 70 climbs over the length control member 42, the toner transporting coil 35 expands and contracts in the length direction thereof, causing vibration. As a result, the toner remaining on the toner transporting coil 35 or near the circular cross-sectioned exit of the first pipe 41 is shaken off. Therefore, the toner remaining near the circular cross-sectioned exit of the first pipe 41 is reduced in amount. Accordingly, when the process cartridge including the toner transporting device 40 according to the present embodiment is detached from the image forming apparatus, spilling of the toner from the exit of the first pipe 41 can be prevented.

In fact, in both a case in which the process cartridge including the toner transporting device 40 illustrated in FIGS. 19 and 20 was used to perform an image forming operation and then detached from the image forming apparatus, and a case in which the process cartridge including the toner transporting device 40 illustrated in FIGS. 21 and 22 was used to perform the image forming operation and then detached from the image forming apparatus, spilling of the toner and toner blocks did not occur.

In the embodiments described above, it is assumed that the toner transporting device 40 is used in an image forming apparatus in which an image is formed on the recording medium by directly transferring the toner image formed on the surface of the photoconductor 10 to the recording medium. It is, of course, possible that the toner transporting device 40 is used in an image forming apparatus in which the toner image formed on the surface of a photoconductor is transferred first to a drum-shaped or belt-shaped intermediate transferring member and then to the recording medium. In this case, the toner transporting device 40 can be used not only for transporting the toner removed from the surface of the photoconductor and collected in a first cleaning device, but also for transporting the toner removed from the surface of the intermediate transferring member and collected in a second cleaning device.

Further, in the embodiments described above, it is assumed that the toner transporting device 40 is used in an image forming apparatus in which a monochrome image is formed on the recording medium. It is also possible to use the toner transporting device 40 in such image forming apparatuses as a revolver-type (i.e., rotary-type) image forming apparatus and a tandem-type image forming apparatus, in which a color image is formed on the recording medium. For example, in the tandem-type image forming apparatus including a plurality of photoconductors and a plurality of cleaning devices provided for the respective plurality of photoconductors, the toner transporting device according to one of the embodiments of the present invention can be provided for each of the plurality of cleaning devices. Furthermore, the tandem-type image forming apparatus can include a plurality of the process cartridges according to one of the embodiments of the present invention.

Moreover, in the embodiments described above, the first pipe 41 is connected via the second pipe 44 to the waste toner tank 46. Alternatively, the first pipe 41 may be connected directly to the waste toner tank 46. In this case, if the toner transporting coil 35 is formed so as to expand and contract, and if the length control member 42 is provided at the downstream end of the first pipe 41 to control the length of the toner transporting coil 35 by allowing the toner transporting coil 35 to press the length control member 42, the effects described above can be similarly obtained. For example, the toner transporting coil 35 can be prevented from interfering with the waste toner tank 46. Further, when a shutter is attached to a component provided at the downstream position of the first pipe 41, the toner transporting coil 35 can be prevented from interfering with the shutter and other components.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The invention claimed is:

1. An image forming apparatus, comprising:

a photoconductor configured to have a toner image formed thereon;

a cleaning device configured to remove toner remaining on the photoconductor after a transfer of the toner image; and a toner transporting device configured to transport the toner removed by the cleaning device, the toner transporting device comprising:

a first toner transport path forming member;

a first toner transporting member partly provided in the first toner transport path forming member and configured to expand and contract in a length direction thereof and transport the toner through the first toner transport path forming member; and a length control member provided at a downstream end of the first toner transport path forming member and configured to be pressed against the first toner transporting member to keep a constant length of the first toner transporting member, wherein the first toner transporting member is longer than the first toner transport path forming member and is compressed by the length control member.

2. The image forming apparatus as described in claim 1, wherein the toner transporting device further comprises a coil shaft configured to extend straight, and the first toner transporting member includes a toner transporting coil having an upstream portion wound around the coil shaft, and wherein the toner transporting coil and the coil shaft are rotated to transport the toner.

3. The image forming apparatus as described in claim 2, wherein the coil shaft has an impeller shape.

4. The image forming apparatus as described in claim 2, wherein the toner transporting device further comprises a tunnel member configured to serve as a bearing to support the first toner transporting member and a downstream end of the coil shaft.

5. The image forming apparatus as described in claim 2, wherein the toner transporting coil has a downstream end provided with an inwardly-bent portion.

6. The image forming apparatus as described in claim 2, wherein the coil shaft has an outer circumferential surface provided with a step configured to engage with and compress a part of the toner transporting coil when the toner transporting coil contracts in the length direction thereof.

7. The image forming apparatus as described in claim 1, wherein the toner transporting device further comprises:

a second toner transport path forming member connected to the first toner transport path forming member; and a second toner transporting member provided in the second toner transport path forming member and configured to continue to transport, through the second toner transport path forming member, the toner transported through the first toner transport path forming member by the first toner transporting member; and wherein the length control member is provided at a connection point between the first and second toner transport path forming members.

8. The image forming apparatus as described in claim 7, wherein the second toner transport path forming member is provided at a position below the first toner transport path forming member relative to the connection point.

9. The image forming apparatus as described in claim 1, wherein the length control member includes a plate having a toner passing hole.

10. The image forming apparatus as described in claim 1, wherein the length control member is formed integrally with the first toner transport path forming member.

11. The image forming apparatus as described in claim 1, wherein the first toner transport path forming member includes a pipe, and the first toner transporting member includes a toner transporting coil which rotates in the pipe to transport the toner, and wherein the length control member, which is pressed against the toner transporting coil, includes a protrusion radially and inwardly protruding from an inner circumferential surface of the pipe at a circular-cross-sectioned exit of the pipe.

12. The image forming apparatus as described in claim 1, wherein the first toner transport path forming member includes a pipe, and the first toner transporting member includes a toner transporting coil which rotates in the pipe to transport the toner, and wherein the length control member, which is pressed against the toner transporting coil, includes a bridging member radially extending across a circular-cross-sectioned exit of the pipe.

13. The image forming apparatus as described in claim 1, wherein the first toner transporting member includes a spiral-shaped member formed from a flat plate.

14. An image forming apparatus, comprising:

photoconductor means for having a toner image formed thereon;

cleaning means for removing toner remaining on the photoconductor means after a transfer of the toner image; and toner transporting means for transporting the toner removed by the cleaning means, the toner transporting means comprising:

first toner transport path forming means;

first toner transporting means partly provided in the first toner transport path forming means for expanding and contracting in a length direction thereof, and for transporting the toner through the first toner transport path forming means; and length control means provided at a downstream end of the first toner transport path forming means for being pressed against the first toner transporting means to keep a constant length of the first toner transporting means, wherein the first toner transporting means is longer than the first toner transport path forming means and is compressed by the length control means.

15. The image forming apparatus as described in claim 14, wherein the toner transporting means further comprises a straight coil shaft means, and the first toner transporting means includes a toner transporting coil having an upstream portion wound around the coil shaft means, and wherein the toner transporting coil and the coil shaft means are rotated to transport the toner.

16. The image forming apparatus as described in claim 15, wherein the coil shaft means has an impeller shape.

17. The image forming apparatus as described in claim 15, wherein the toner transporting means further comprises tunnel means for serving as a bearing for supporting the first toner transporting means and a downstream end of the coil shaft means.

18. The image forming apparatus as described in claim 15, wherein the toner transporting coil has a downstream end provided with an inwardly-bent portion.

19. The image forming apparatus as described in claim 15, wherein the coil shaft means has an outer circumferential surface provided with step means for engaging with and compressing a part of the toner transporting coil when the toner transporting coil contracts in the length direction thereof.

20. The image forming apparatus as described in claim 14, wherein the toner transporting means further comprises:

second toner transport path forming means connected to the first toner transport path forming means; and second toner transporting means provided in the second toner transport path forming means for continuing to transport, through the second toner transport path forming means, the toner transported through the first toner transport path forming means by the first toner transporting means; and wherein the length control means is provided at a connection point between the first and second toner transport path forming means.

21. The image forming apparatus as described in claim 20, wherein the second toner transport path forming means is provided at a position below the first toner transport path forming means relative to the connection point.

22. The image forming apparatus as described in claim 14, wherein the length control means includes a plate having a toner passing hole.

23. The image forming apparatus as described in claim 14, wherein the length control means is formed integrally with the first toner transport path forming means.

24. The image forming apparatus as described in claim 14, wherein the first toner transport path forming means includes a pipe, and the first toner transporting means includes a toner transporting coil which rotates in the pipe to transport the toner, and wherein the length control means, which is pressed against the toner transporting coil, includes a protrusion radially and inwardly protruding from an inner circumferential surface of the pipe at a circular-cross-sectioned exit of the pipe.

25. The image forming apparatus as described in claim 14, wherein the first toner transport path forming means includes a pipe, and the first toner transporting means includes a toner transporting coil which rotates in the pipe to transport the toner, and wherein the length control means, which is pressed against the toner transporting coil, includes a bridging member radially extending across a circular-cross-sectioned exit of the pipe.

26. The image forming apparatus as described in claim 14, wherein the first toner transporting means includes a spiral-shaped member formed from a flat plate.

27. An image forming method for effectively transporting toner, comprising:

providing a photoconductor, a cleaning device, and a toner transporting device;

providing, in the toner transporting device, a first toner transport path forming member, a first toner transporting member configured to expand and contract in a length direction thereof, and a length control member configured to be pressed against the first toner transporting member to keep a constant length of the first toner transporting member, the first toner transporting member being longer than the first toner transport path forming member and being compressed by the length control member;

inserting a part of the first toner transporting member in the first toner transport path forming member;

locating the length control member at a downstream end of the first toner transport path forming member;

forming a toner image on the photoconductor;

causing the cleaning device to remove toner remaining on the photoconductor after a transfer of the toner image; and causing the first toner transporting member to transport the toner removed by the cleaning device through the first toner transport path forming member.

28. The image forming method as described in claim 27, further comprising:

providing a coil shaft configured to extend straight;

including a toner transporting coil in the first toner transporting member;

winding an upstream portion of the toner transporting coil around the coil shaft; and rotating the toner transporting coil and the coil shaft to transport the toner.

29. The image forming method as described in claim 28, further comprising forming the coil shaft as an impeller shape.

30. The image forming method as described in claim 28, further comprising providing a tunnel member configured to serve as a bearing for supporting the first toner transporting member and a downstream end of the coil shaft.

31. The image forming method as described in claim 28, further comprising providing a downstream end of the toner transporting coil with an inwardly-bent portion.

32. The image forming method as described in claim 28, further comprising:

providing an outer circumferential surface of the coil shaft with a step; and causing the step to engage with and compress a part of the toner transporting coil when the toner transporting coil contracts in the length direction thereof.

33. The image forming method as described in claim 27, further comprising:

providing, in the toner transporting device, a second toner transport path forming member and a second toner transporting member;

inserting the second toner transporting member in the second toner transport path forming member;

connecting the second toner transport path forming member to the first toner transport path forming member;

placing the length control member at a connection point between the first and second toner transport path forming members; and causing the second toner transporting member to continue to transport, through the second toner transport path forming member, the toner transported through the first toner transport path forming member by the first toner transporting member.

34. The image forming method as described in claim 33, further comprising placing the second toner transport path forming member at a position below the first toner transport path forming member relative to the connection point.

35. The image forming method as described in claim 27, further comprising including a plate having a toner passing hole in the length control member.

36. The image forming method as described in claim 27, further comprising forming the length control member integrally with the first toner transport path forming member.

37. The image forming method as described in claim 27, further comprising:

including a pipe in the first toner transport path forming member;

including, in the first toner transporting member, a toner transporting coil which rotates in the pipe to transport the toner; and providing the length control member, which is pressed against the toner transporting coil, with a protrusion radially and inwardly protruding from an inner circumferential surface of the pipe at a circular-cross-sectioned exit of the pipe.

38. The image forming method as described in claim 27, further comprising:

including a pipe in the first toner transport path forming member;

including, in the first toner transporting member, a toner transporting coil which rotates in the pipe to transport the toner; and providing the length control member, which is pressed against the toner transporting coil, with a bridging member radially extending across a circular-cross-sectioned exit of the pipe.

39. The image forming method as described in claim 27, further comprising including, in the first toner transporting member, a spiral-shaped member formed from a flat plate.

40. A process cartridge, comprising:

a cleaning device configured to remove toner remaining on a photoconductor; and a toner transporting device configured to transport the toner removed by the cleaning device, the toner transporting device comprising:

a first toner transport path forming member;

a first toner transporting member partly provided in the first toner transport path forming member and configured to expand and contract in a length direction thereof and transport the toner through the first toner transport path forming member; and a length control member provided at a downstream end of the first toner transport path forming member and configured to be pressed against the first toner transporting member to keep a constant length of the first toner transporting member, wherein the first toner transporting member is longer than the first toner transport path forming member and is compressed by the length control member.

41. The process cartridge as described in claim 40, wherein the toner transporting device further comprises a coil shaft configured to extend straight, and the first toner transporting member includes a toner transporting coil having an upstream portion wound around the coil shaft, and wherein the toner transporting coil and the coil shaft are rotated to transport the toner.

42. The process cartridge as described in claim 41, wherein the coil shaft has an impeller shape.

43. The process cartridge as described in claim 41, wherein the toner transporting device further comprises a tunnel member configured to serve as a bearing for supporting the first toner transporting member and a downstream end of the coil shaft.

44. The process cartridge as described in claim 41, wherein the toner transporting coil has a downstream end provided with an inwardly-bent portion.

45. The process cartridge as described in claim 41, wherein the coil shaft has an outer circumferential surface provided with a step configured to engage with and compress a part of the toner transporting coil when the toner transporting coil contracts in the length direction thereof.

46. The process cartridge as described in claim 40, wherein the toner transporting device further comprises:

a second toner transport path forming member connected to the first toner transport path forming member; and a second toner transporting member provided in the second toner transport path forming member and configured to continue to transport, through the second toner transport path forming member, the toner transported through the first toner transport path forming member by the first toner transporting member; and wherein the length control member is provided at a connection point between the first and second toner transport path forming members.

47. The process cartridge as described in claim 46, wherein the second toner transport path forming member is provided at a position below the first toner transport path forming member relative to the connection point.

48. The process cartridge as described in claim 40, wherein the length control member includes a plate having a toner passing hole.

49. The process cartridge as described in claim 40, wherein the length control member is formed integrally with the first toner transport path forming member.

50. The process cartridge as described in claim 40, wherein the first toner transport path forming member includes a pipe, and the first toner transporting member includes a toner transporting coil which rotates in the pipe to transport the toner, and wherein the length control member, which is pressed against the toner transporting coil, includes a protrusion radially and inwardly protruding from an inner circumferential surface of the pipe at a circular-cross-sectioned exit of the pipe.

51. The process cartridge as described in claim 40, wherein the first toner transport path forming member includes a pipe, and the first toner transporting member includes a toner transporting coil which rotates in the pipe to transport the toner, and wherein the length control member, which is pressed against the toner transporting coil, includes a bridging member radially extending across a circular-cross-sectioned exit of the pipe.

52. The process cartridge as described in claim 40, wherein the first toner transporting member includes a spiral-shaped member formed from a flat plate.

53. A toner transporting device comprising:

a first toner transport path forming member;

a first toner transporting member partly provided in the first toner transport path forming member and configured to expand and contract in a length direction thereof and transport the toner through the first toner transport path forming member; and a length control member provided at a downstream end of the first toner transport path forming member and configured to be pressed against the first toner transporting member to keep a constant length of the first toner transporting member, wherein the first toner transporting member is longer than the first toner transport path forming member and is compressed by the length control member.

54. The toner transporting device as described in claim 53, further comprising a coil shaft configured to extend straight, wherein the first toner transporting member includes a toner transporting coil having an upstream portion wound around the coil shaft, and wherein the toner transporting coil and the coil shaft are rotated to transport the toner.

55. The toner transporting device as described in claim 54, wherein the coil shaft has an impeller shape.

56. The toner transporting device as described in claim 54, further comprising a tunnel member configured to serve as a bearing for supporting the first toner transporting member and a downstream end of the coil shaft.

57. The toner transporting device as described in claim 54, wherein the toner transporting coil has a downstream end provided with an inwardly-bent portion.

58. The toner transporting device as described in claim 54, wherein the coil shaft has an outer circumferential surface provided with a step configured to engage with and compress a part of the toner transporting coil when the toner transporting coil contracts in the length direction thereof.

59. The toner transporting device as described in claim 53, further comprising:

a second toner transport path forming member connected to the first toner transport path forming member; and a second toner transporting member provided in the second toner transport path forming member and configured to continue to transport, through the second toner transport path forming member, the toner transported through the first toner transport path forming member by the first toner transporting member; and wherein the length control member is provided at a connection point between the first and second toner transport path forming members.

60. The toner transporting device as described in claim 59, wherein the second toner transport path forming member is provided at a position below the first toner transport path forming member relative to the connection point.

61. The toner transporting device as described in claim 53, wherein the length control member includes a plate having a toner passing hole.

62. The toner transporting device as described in claim 53, wherein the length control member is formed integrally with the first toner transport path forming member.

63. The toner transporting device as described in claim 53, wherein the first toner transport path forming member includes a pipe, and the first toner transporting member includes a toner transporting coil which rotates in the pipe to transport the toner, and wherein the length control member, which is pressed against the toner transporting coil, includes a protrusion radially and inwardly protruding from an inner circumferential surface of the pipe at a circular-cross-sectioned exit of the pipe.

64. The toner transporting device as described in claim 53, wherein the first toner transport path forming member includes a pipe, and the first toner transporting member includes a toner transporting coil which rotates in the pipe to transport the toner, and wherein the length control member, which is pressed against the toner transporting coil, includes a bridging member radially extending across a circular-cross-sectioned exit of the pipe.

65. The toner transporting device as described in claim 53, wherein the first toner transporting member includes a spiral-shaped member formed from a flat plate.

66. A toner transporting device comprising:

first toner transport path forming means;

first toner transporting means partly provided in the first toner transport path forming means for expanding and contracting in a length direction thereof, and for transporting the toner through the first toner transport path forming means; and length control means provided at a downstream end of the first toner transport path forming means for being pressed against the first toner transporting means to keep a constant length of the first toner transporting means, wherein the first toner transporting means is longer than the first toner transport path forming means and is compressed by the length control means.

67. The toner transporting device as described in claim 66, further comprising a straight coil shaft means, wherein the first toner transporting means includes a toner transporting coil having an upstream portion wound around the coil shaft means, and wherein the toner transporting coil and the coil shaft means are rotated to transport the toner.

68. The toner transporting device as described in claim 67, wherein the coil shaft means has an impeller shape.

69. The toner transporting device as described in claim 67, further comprising tunnel means for serving as a bearing for supporting the first toner transporting means and a downstream end of the coil shaft means.

70. The toner transporting device as described in claim 67, wherein the toner transporting coil has a downstream end provided with an inwardly-bent portion.

71. The toner transporting device as described in claim 67, wherein the coil shaft means has an outer circumferential surface provided with step means for engaging with and compressing a part of the toner transporting coil when the toner transporting coil contracts in the length direction thereof.

72. The toner transporting device as described in claim 66, further comprising:

second toner transport path forming means connected to the first toner transport path forming means; and second toner transporting means provided in the second toner transport path forming means for continuing to transport, through the second toner transport path forming means, the toner transported through the first toner transport path forming means by the first toner transporting means; and wherein the length control means is provided at a connection point between the first and second toner transport path forming means.

73. The toner transporting device as described in claim 72, wherein the second toner transport path forming means is provided at a position below the first toner transport path forming means relative to the connection point.

74. The toner transporting device as described in claim 66, wherein the length control means includes a plate having a toner passing hole.

75. The toner transporting device as described in claim 66, wherein the length control means is formed integrally with the first toner transport path forming means.

76. The toner transporting device as described in claim 66, wherein the first toner transport path forming means includes a pipe, and the first toner transporting means includes a toner transporting coil which rotates in the pipe to transport the toner, and wherein the length control means, which is pressed against the toner transporting coil, includes a protrusion radially and inwardly protruding from an inner circumferential surface of the pipe at a circular-cross-sectioned exit of the pipe.

77. The toner transporting device as described in claim 66, wherein the first toner transport path forming means includes a pipe, and the first toner transporting means includes a toner transporting coil which rotates in the pipe to transport the toner, and wherein the length control means, which is pressed against the toner transporting coil, includes a bridging member radially extending across a circular-cross-sectioned exit of the pipe.

78. The toner transporting device as described in claim 66, wherein the first toner transporting means includes a spiral-shaped member formed from a flat plate.

79. A toner transporting method, comprising:

providing a first toner transport path forming member, a first toner transporting member configured to expand and contract in a length direction thereof, and a length control member configured to be pressed against the first toner transporting member to keep a constant length of the first toner transporting member, the first toner transporting member being longer than the first toner transport path forming member and being compressed by the length control member;

inserting a part of the first toner transporting member in the first toner transport path forming member;

locating the length control member at a downstream end of the first toner transport path forming member; and causing the first toner transporting member to transport toner through the first toner transport path forming member.

80. The toner transporting method as described in claim 79, further comprising:

providing a coil shaft configured to extend straight;

including a toner transporting coil in the first toner transporting member;

winding an upstream portion of the toner transporting coil around the coil shaft; and rotating the toner transporting coil and the coil shaft to transport the toner.

81. The toner transporting method as described in claim 80, further comprising forming the coil shaft as an impeller shape.

82. The toner transporting method as described in claim 80, further comprising providing a tunnel member configured to serve as a bearing for supporting the first toner transporting member and a downstream end of the coil shaft.

83. The toner transporting method as described in claim 80, further comprising providing a downstream end of the toner transporting coil with an inwardly-bent portion.

84. The toner transporting method as described in claim 80, further comprising:

providing an outer circumferential surface of the coil shaft with a step; and causing the step to engage with and compress a part of the toner transporting coil when the toner transporting coil contracts in the length direction thereof.

85. The toner transporting method as described in claim 79, further comprising:

providing a second toner transport path forming member and a second toner transporting member;

inserting the second toner transporting member in the second toner transport path forming member;

connecting the second toner transport path forming member to the first toner transport path forming member;

placing the length control member at a connection point between the first and second toner transport path forming members; and causing the second toner transporting member to continue to transport, through the second toner transport path forming member, the toner transported through the first toner transport path forming member by the first toner transporting member.

86. The toner transporting method as described in claim 85, further comprising placing the second toner transport path forming member at a position below the first toner transport path forming member relative to the connection point.

87. The toner transporting method as described in claim 79, further comprising including a plate having a toner passing hole in the length control member.

88. The toner transporting method as described in claim 79, further comprising forming the length control member integrally with the first toner transport path forming member.

89. The toner transporting method as described in claim 79, further comprising:

including a pipe in the first toner transport path forming member;

including, in the first toner transporting member, a toner transporting coil which rotates in the pipe to transport the toner; and providing the length control member, which is pressed against the toner transporting coil, with a protrusion radially and inwardly protruding from an inner circumferential surface of the pipe at a circular-cross-sectioned exit of the pipe.

90. The toner transporting method as described in claim 79, further comprising:

including a pipe in the first toner transport path forming member;

including, in the first toner transporting member, a toner transporting coil which rotates in the pipe to transport the toner; and providing the length control member, which is pressed against the toner transporting coil, with a bridging member radially extending across a circular-cross-sectioned exit of the pipe.

91. The toner transporting method as described in claim 79, further comprising including, in the first toner transporting member, a spiral-shaped member formed from a flat plate.

* * * * *